US008936345B2

(12) United States Patent
Tamaki

(10) Patent No.: US 8,936,345 B2
(45) Date of Patent: Jan. 20, 2015

(54) LIQUID EJECTION APPARATUS

(71) Applicant: Shuichi Tamaki, Nagoya (JP)

(72) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/781,553

(22) Filed: Feb. 28, 2013

(65) Prior Publication Data

US 2013/0222469 A1 Aug. 29, 2013

(30) Foreign Application Priority Data

Feb. 29, 2012 (JP) ..... 2012-042982

(51) Int. Cl.
*B41J 2/165* (2006.01)

(52) U.S. Cl.
CPC ..... *B41J 2/16505* (2013.01); *B41J 2/165* (2013.01); *B41J 2002/16555* (2013.01)
USPC ..... 347/29

(58) Field of Classification Search
USPC ..... 347/21, 22, 29
See application file for complete search history.

(56) References Cited

U.S. PATENT DOCUMENTS

| | | | | |
|---|---|---|---|---|
| 6,158,838 | A | 12/2000 | Capurso | |
| 6,491,369 | B1 | 12/2002 | Satoh et al. | |
| 7,748,821 | B2 | 7/2010 | Nakashima | |
| 2010/0147891 | A1* | 6/2010 | Yoshihisa | 222/192 |
| 2011/0242204 | A1* | 10/2011 | Shinoda | 347/29 |
| 2012/0206537 | A1* | 8/2012 | Nukui et al. | 347/32 |
| 2013/0221127 | A1 | 8/2013 | Tamaki | |
| 2013/0222470 | A1 | 8/2013 | Tamaki | |

FOREIGN PATENT DOCUMENTS

JP 2008-207514 A 9/2008

OTHER PUBLICATIONS

United States Patent and Trademark Office, Notice of Allowance for U.S. Appl. No. 13/781,629 (related to above-captioned patent application), mailed Nov. 26, 2013.

United States Patent and Trademark Office, Non Final Office Action for U.S. Appl. No. 13/781,654 (related to above-captioned patent application), mailed Jun. 20, 2014.

* cited by examiner

*Primary Examiner* — Stephen Meier
*Assistant Examiner* — Renee I Wilson
(74) *Attorney, Agent, or Firm* — Baker Botts L.L.P.

(57) ABSTRACT

A capping mechanism selectively takes a capped state in which an ejection space opposing an ejection surface is covered or an uncapped state in which the ejection space is not covered. A controller is configured to: determine whether a first change of the capping mechanism from the capped state to the uncapped state occurred while air moisturized by a moisturization mechanism is being moved to the ejection space by a ventilator or not; and when a second change of the capping mechanism from the uncapped state to the capped state occurred after the first change occurred, control the ventilator to move the air moisturized by the moisturization mechanism to the ejection space when a first uncapped time is shorter than a first predetermined time, and control a discharger to discharge the liquid through ejection openings when the first uncapped time is not shorter than the first predetermined time.

11 Claims, 14 Drawing Sheets

LIQUID EJECTION APPARATUS

CROSS REFERENCE TO RELATED APPLICATION

The present application claims priority from Japanese Patent Application No. 2012-042982, which was filed on Feb. 29, 2012, the disclosure of which is incorporated herein by reference in its entirety.

BACKGROUND OF THE INVENTION

1. Field of the Invention

The present invention relates to a liquid ejection apparatus capable of ejecting liquid such as ink.

2. Description of Related Art

In connection with liquid ejection apparatuses, a technology concerning maintenance for restoring or maintaining the state of liquid in an ejection opening has been known. According to this technology, moist air is supplied to an ejection space opposing an ejection surface of a head for a predetermined time while the ejection space is separated from a space surrounding the ejection space by a capping mechanism.

SUMMARY OF THE INVENTION

While the moist air is supplied to the ejection space, the ejection space may be opened to the surrounding space when a user moves the liquid ejection apparatus. In such a case, according to the technology above, it is assumed that the ejection space is closed by the capping mechanism again and the moist air is supplied again to the ejection space for the predetermined time. However, if the moisturization is conducted in the same condition irrespective of the time length in which the ejection space is open to the surrounding space, the efficiency in the maintenance may be deteriorated, e.g., extra time is required to restore or maintain the state of the liquid in the ejection opening.

An object of the present invention is to provide a liquid ejection apparatus which allows the maintenance of a head even if the state of a capping mechanism is changed from a capped state to an uncapped state while moist air is being supplied to an ejection space.

According to a first aspect of the present invention, there is provided a liquid ejection apparatus comprising a head, a capping mechanism, a discharger, an inflow path, an outflow path, a moisturization mechanism, a ventilator, a first sensor, and a controller. The head comprises an ejection surface in which a plurality of ejection openings for ejecting liquid are formed. The capping mechanism is configured to selectively take a capped state in which an ejection space opposing the ejection surface is covered or an uncapped state in which the ejection space is not covered. The discharger is configured to discharge liquid in the head through the ejection openings. The inflow path is configured to be connected to the ejection space when the capping mechanism is in the capped state and to allow air flow towards the ejection space passing through the inflow path. The outflow path is configured to be connected to the ejection space when the capping mechanism is in the capped state and to allow air flow from the ejection space passing through the outflow path. The moisturization mechanism is configured to moisturize the air passing through the inflow path. The ventilator is configured to move the air in the inflow path to the ejection space. The first sensor is configured to output a first signal relative to a state corresponding to the uncapped state. The controller is configured to: determine whether a first change of the capping mechanism from the capped state to the uncapped state occurred while air moisturized by the moisturization mechanism is being moved to the ejection space by the ventilator or not based on the first signal; determine whether a second change of the capping mechanism from the uncapped state to the capped state occurred or not based on the first signal; calculate a first uncapped time which is a time length from a time point at which the controller determined the first change occurred to a time point at which the controller determined the second change occurred; and when the second change occurred after the first change occurred, control the ventilator to move the air moisturized by the moisturization mechanism to the ejection space when the first uncapped time is shorter than a first predetermined time, and control the discharger to discharge the liquid through the ejection openings when the first uncapped time is not shorter than the first predetermined time.

According to a second aspect of the present invention, there is provided a liquid ejection apparatus comprising a head, a capping mechanism, a discharger, an inflow path, an outflow path, a moisturization mechanism, a ventilator, a first sensor, and a controller. The head comprises an ejection surface in which a plurality of ejection openings for ejecting liquid are formed. The capping mechanism is configured to selectively take a capped state in which an ejection space opposing the ejection surface is covered or an uncapped state in which the ejection space is not covered. The discharger is configured to discharge liquid in the head through the ejection openings. The inflow path is configured to be connected to the ejection space when the capping mechanism is in the capped state and to allow air flow towards the ejection space passing through the inflow path. The outflow path is configured to be connected to the ejection space when the capping mechanism is in the capped state and to allow air flow out from the ejection space passing through the outflow path. The moisturization mechanism is configured to moisturize the air passing through the inflow path. The ventilator is configured to move the air in the inflow path to the ejection space. The first sensor is configured to output a first signal relative to a state corresponding to the uncapped state. The controller is configured to: determine whether a first change of the capping mechanism from the capped state to the uncapped state occurred while air moisturized by the moisturization mechanism is being moved to the ejection space by the ventilator and while the capping mechanism is not being controlled by the controller or not based on the first signal; determine whether a second change of the capping mechanism from the uncapped state to the capped state occurred or not based on the first signal; calculate a first uncapped time which is a time length from a time point at which the controller determined the first change occurred to a time point at which the controller determined the second change occurred; and when the second change occurred after the first change occurred, control the discharger to discharge the liquid through the ejection openings when the first uncapped time is not shorter than a first predetermined time.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following will describe a preferred embodiment of the present invention with reference to figures.

Figure 1:
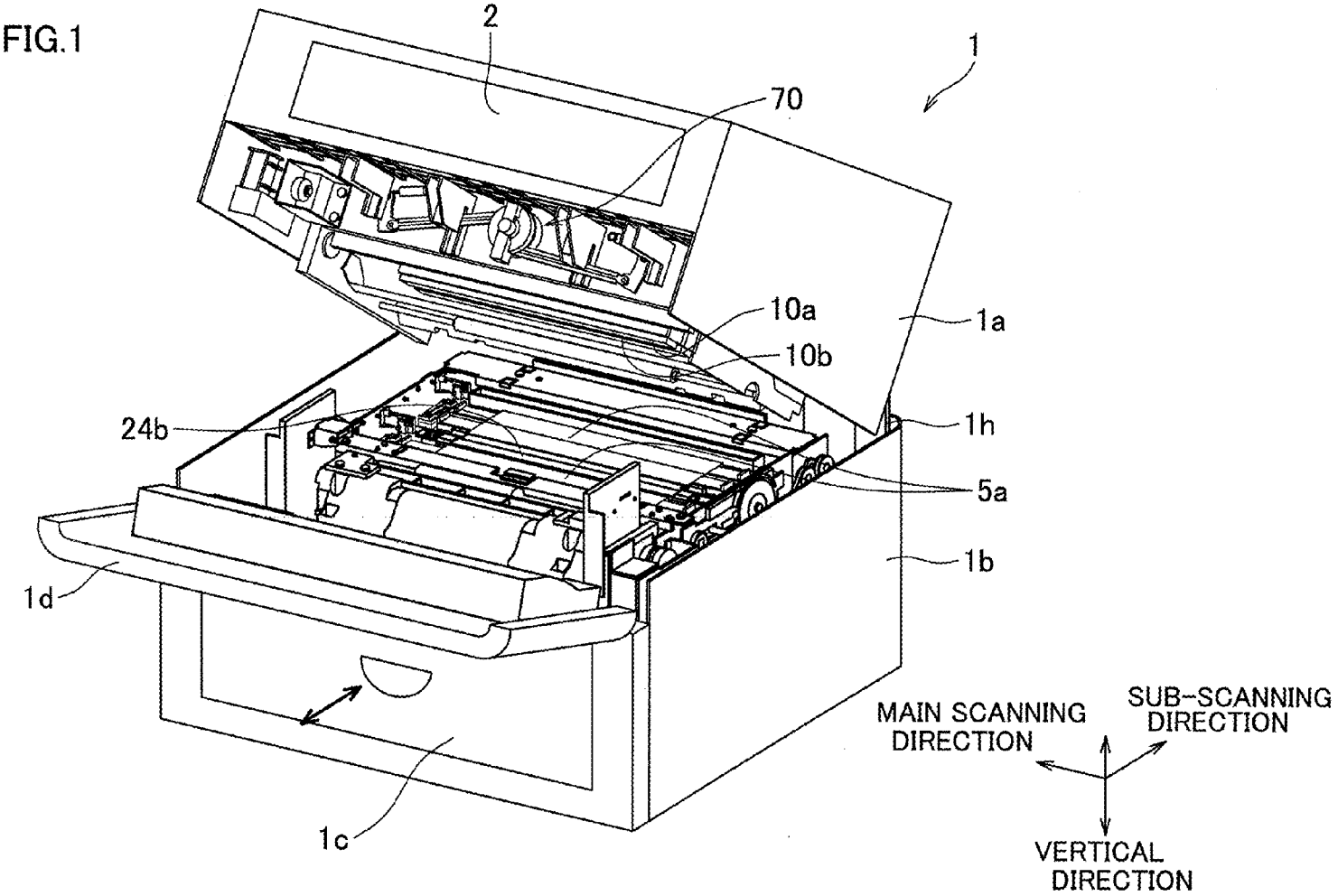
FIG. 1 is an oblique perspective of the appearance of an inkjet printer of First Embodiment of the present invention.

To begin with, referring to FIG. 1 and FIG. 2, the overall structure of an inkjet printer 1 of First Embodiment of the present invention will be described.

The printer 1 includes an upper housing 1*a* and a lower housing 1*b* which are both rectangular parallelepiped and are substantially identical in size. The upper housing 1*a* is an open-bottom box whereas the lower housing 1*b* is an open-top box. As the upper housing 1*a* is put on the lower housing 1*b* so that each closes the opening of the other, the space inside the printer 1 is defined (see FIG. 2).

On the top plate of the upper housing 1*a* is provided a sheet discharge section 31. In the space defined by the housings 1*a* and 1*b*, a conveying path on which sheets P are conveyed is formed from a sheet supply unit 1*c* toward a sheet discharge section 31, along the thick arrows shown in FIG. 2.

The upper housing 1*a* is arranged to be rotatable with respect to the lower housing 1*b* about a hinge 1*h* which is a lower side of the upper housing 1*a*. On account of the rotation, the upper housing 1*a* selectively takes a close position (FIG. 2) where the upper housing 1*a* is close to the lower housing 1*b* or a separated position (FIG. 1) where the upper housing 1*a* is separated from the lower housing 1*b* as compared to the close position. The upper housing 1*a* is regulated by a stopper or the like so as not to open more than a predetermined angle (e.g., 29 degrees) with respect to the horizontal plane. When the upper housing 1*a* is at the separated position, a part of the conveying path is exposed and a working space for the user is formed between the upper housing 1*a* and the lower housing 1*b*. This working space allows the user to manually clean heads 10*a* and 10*b*, remove a sheet P jammed at the conveying path, and so on.

On the front surface of the upper housing 1*a* (i.e., the face on the left side in FIG. 1) are provided a cartridge 2 and a locking mechanism 70. The cartridge 2 includes a preprocessing liquid container containing preprocessing liquid, an ink container containing black ink, a moisturizing liquid container containing moisturizing liquid, and a housing which houses these three containers. The preprocessing liquid has a function of preventing ink from spreading on or penetrating a sheet, a function of improving the coloring and quick dry properties of the ink, or the like, by coagulating pigment in the ink. The preprocessing liquid may include polyvalent metal salt such as cationic polymer and magnesium salt. The moisturizing liquid may be water to which pure water, preservative or the like is added. The preprocessing liquid container, the ink container, and the moisturizing liquid container are connected to a head 10*a*, ahead 10*b*, and a tank 51 (see FIG. 9) via tubes or the like, respectively. The liquid in each container is suitably supplied to each of the heads 10*a* and 10*b* and the tank 51 by the driving of pumps 2Pa, 2Pb, and 2Pc (see FIG. 11) under the control of the controller 1*p*. The locking mechanism 70 restricts the movement of the upper housing 1*a* when the upper housing 1*a* is at the close position. On the front surface of the lower housing 1*b* is provided a lid Id which is openable and able to cover the front surface of the upper housing 1*a*. As the lid 1*d* is opened, the locking mechanism 70 is exposed. The details of the locking mechanism 70 will be given later.

Figure 2:
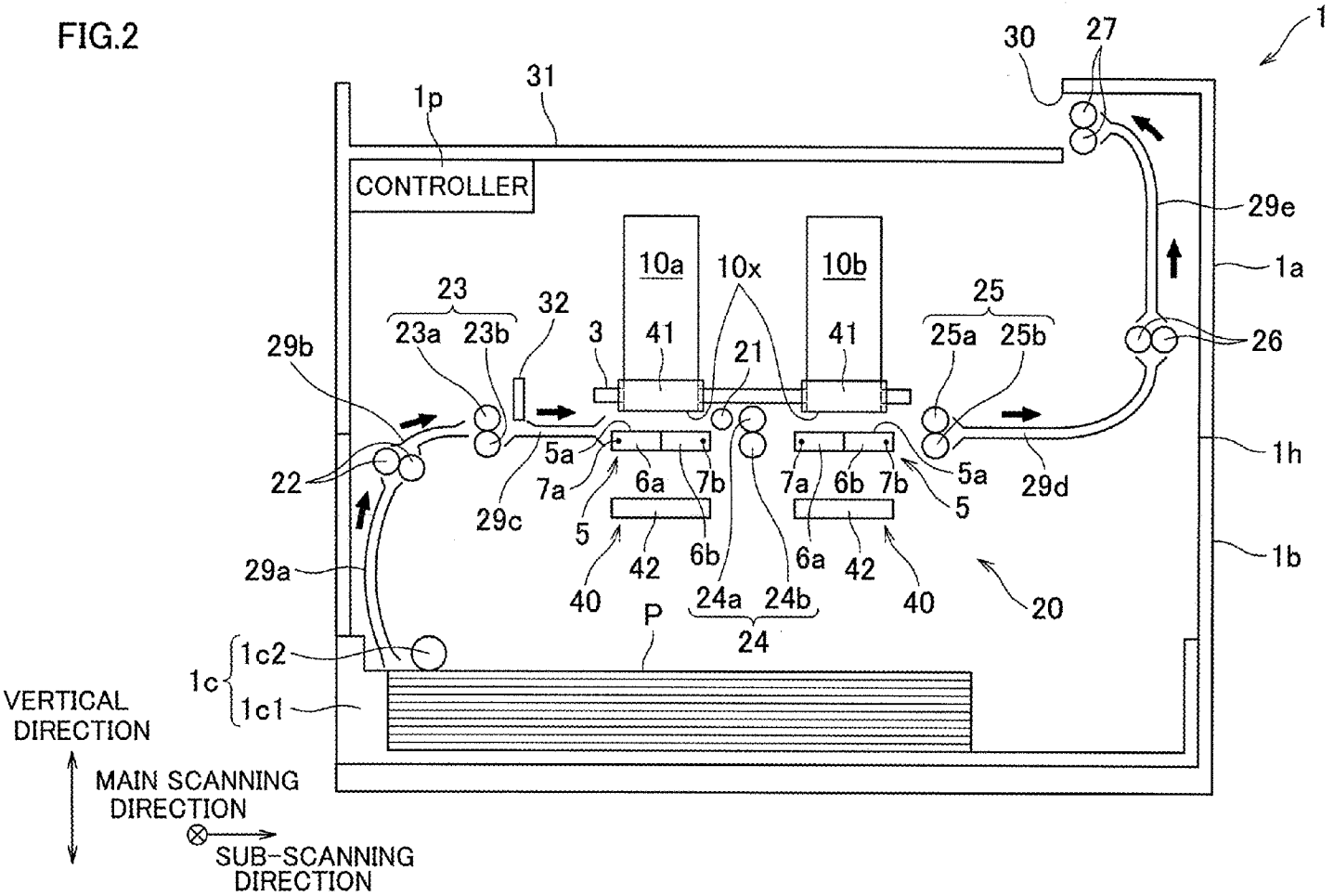
FIG. 2 is a schematic profile showing the internal structure of the printer.
Figure 8A:
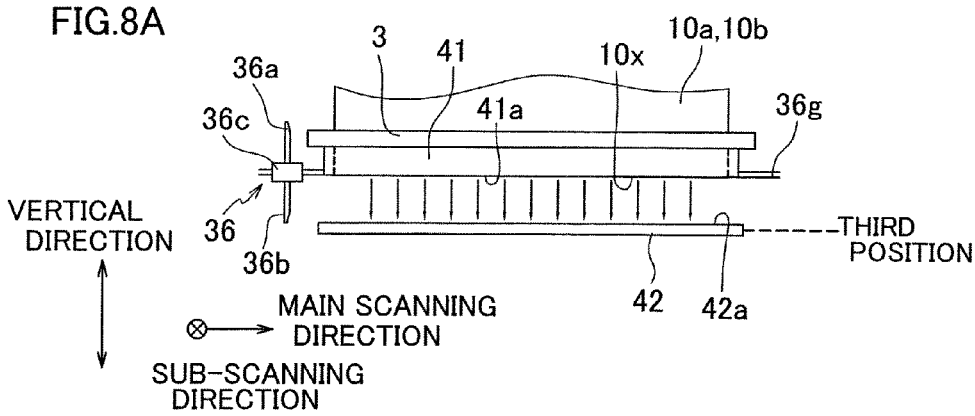
FIG. 8A illustrates purging.

The upper housing 1*a* supports members such as the heads 10*a* and 10*b*, a controller 1*p*, and a part of the conveying unit 20 (see FIG. 2). The lower housing 1*b* supports members such as opposing members 42, the remaining part of the conveying unit 20, a sheet supply unit 1*c*, wiper units 36 (see FIG. 8A to FIG. 8C) provided for the respective heads 10*a* and 10*b*, and a tank 51 (see FIG. 9) of the moisturizing unit 50.

The heads 10*a* and 10*b* are identical with each other in structure and are line-type heads each being substantially rectangular parallelepiped and long in the main scanning direction (i.e., in the direction orthogonal to FIG. 2). For recording (image formation), preprocessing liquid and black ink (which may be referred to generally as liquid) are ejected from the lower surface (ejection surface 10*x*) of each of the heads 10*a* and 10*b*. The heads 10*a* and 10*b* are disposed at predetermined intervals in the sub-scanning direction (which is orthogonal to the main scanning direction and the vertical direction), and are supported by the upper housing 1*a* via a holder 3. The holder 3 also supports an annular member 41 which is provided for each of the heads 10*a* and 10*b*. The annular member 41 encloses the ejection surface 10*x* in plan view.

The opposing members 42 are disposed vertically below the respective heads 10*a* and 10*b*. The opposing member 42 is a rectangular plate which is a size larger than the annular member 41 and made of a material which does not absorb or hardly absorbs moisture, such as glass and metal (e.g., SUS). The annular member 41 and the opposing member 42 constitute a capping mechanism 40. The details of the capping mechanism 40 will be given later.

The conveying unit 20 includes supporting mechanisms 5, roller pairs 22, 23, 24, 25, 26, and 27, guides 29*a*, 29*b*, 29*c*, 29*d*, and 29*e*, and an intermediate roller 21.

Among the members of the conveying unit 20, the intermediate roller 21, the upper roller 24*a* of the roller pair 24, the roller pairs 26 and 27, and the guides 29*d* and 29*e* are supported by the upper housing 1*a*. The supporting mechanisms 5, the roller pairs 22, 23, and 25, the lower roller 24*b* of the roller pair 24, and the guides 29*a*, 29*b*, and 29*c* are supported by the lower housing 1*b*.

The supporting mechanisms 5 are disposed vertically below the heads 10*a* and 10*b*, respectively. Each supporting mechanism 5 is constituted by two platens 6*a* and 6*b*. The platens 6*a* and 6*b* are arranged to be rotatable about the shafts 7*a* and 7*b*. Under the control of the controller 1*p*, the platens 6*a* and 6*b* are rotated by a platen rotation motor 5M (see FIG. 11), and selectively take a supporting surface forming position (FIG. 1) or an open position (FIG. 7B). At the supporting surface forming position, the leading ends of the platens 6*a* and 6*b* contact each other and these platens 6*a* and 6*b* form the supporting surface 5*a* which supports a sheet P while opposing the ejection surface 10*x*. The supporting surface 5*a* is basically flat in shape. At the open position the platens 6*a* and 6*b* hang down. The platens 6*a* and 6*b* are at the supporting surface forming position at the time of recording, and are at the open position at the time of maintenance.

The maintenance is operations to restore or maintain the state of the liquid in the ejection opening 14*a*, including capping, wiping, a liquid discharge operation (including flushing and purging), a moisturization operation, or the like. These operations are executed when, for example, a user instructs to perform it while the controller 1*p* does not receive a recording command. The details of the operations will be given later.

The roller pairs 22 to 27 are disposed in this order from the upstream in the conveyance direction to form a conveying path connecting the sheet supply unit 1*c* with the sheet discharge section 31. The lower rollers 23*b*, 24*b*, and 25*b* of the roller pairs 23 to 25 and one rollers of the roller pairs 26 and 27 are connected to a conveyance motor 20M (see FIG. 11). These rollers are drive rollers which are rotated by the conveyance motor 20M under the control of the controller 1*p*. The upper rollers 23*a*, 24*a*, and 25*a* of the roller pair 23 to 25 and the other rollers of the roller pairs 26 and 27 are driven rollers.

The guides 29*a* to 29*e* are disposed in this order between the sheet supply unit 1*c* and the roller pair 22 and between the roller pairs from the upstream in the conveyance direction, so as to form the conveying path. Each of the guides 29*a* to 29*e* is constituted by a pair of plates which are distanced from each other.

The intermediate roller 21 is disposed between the head 10*a* and the roller pair 24 and vertically above the conveying path.

The sheet supply unit 1*c* includes a sheet feeding tray 1*c*1 and a pickup roller 1*c*2. The sheet feeding tray 1*c*1 is detachable to the lower housing 1*b* in the sub-scanning direction. The sheet feeding tray 1*c*1 is an open-top box capable of storing sheets P with different sizes. Under the control of the controller 1*p*, the pickup roller 1*c*2 is rotated by a pickup motor 1*c*M (see FIG. 11) to send out the vertically topmost sheet P in the sheet feeding tray 1*c*1.

The controller 1*p* includes, in addition to a CPU (Central Processing Unit) which is a processing unit, members such as a ROM (Read Only Memory), a RAM (Random Access Memory: including non-volatile RAM), an ASIC (Application Specific Integrated Circuit), an I/F (Interface), an I/O (Input/Output Port), and an internal timer for measuring time. The ROM stores a program executed by the CPU, various fixed data, or the like. The RAM temporarily stores data (such as image data) required for the execution of a program. The ASIC executes the rewriting, sorting or the like (e.g., signal processing and image processing) of image data. The I/F exchanges data with an external apparatus. The I/O deals with input/output of detection signals of various sensors. Alternatively, no ASIC may be provided and the rewriting, sorting or the like of image data may be performed by a program executed by the CPU or the like.

Based on a recording command supplied from an external apparatus (e.g., a PC connected to the printer 1), the controller 1*p* controls the preparation operation concerning recording, the supply/conveyance/discharge operation of a sheet P, a liquid ejection operation in sync with the conveyance of a sheet P, or the like, in order to form an image on the sheet P. A sheet P sent out from the sheet supply unit 1*c* passes through the spaces between the guides 29*a* to 29*e* and is conveyed in the conveyance direction, while being sandwiched between the roller pairs 22 to 27. Each time a sheet P passes through the position immediately below each of the heads 10*a* and 10*b* while being supported by the supporting surface 5*a*, each of the heads 10*a* and 10*b* is driven under the control of the controller 1*p* and liquid is ejected from an ejection opening 14*a* (see FIG. 6) of each ejection surface 10*x* to the surface of the sheet P, with the result that an image is formed on the sheet P. The operation to eject the liquid from the ejection opening 14*a* is performed based on a detection signal supplied from a sheet, sensor 32 which detects the leading end of a sheet P. The sheet P is then conveyed upward and is discharged to the sheet discharge section 31 through an opening 30 which is formed at an upper part of the upper housing 1*a*.

Figures 3A, 3B:
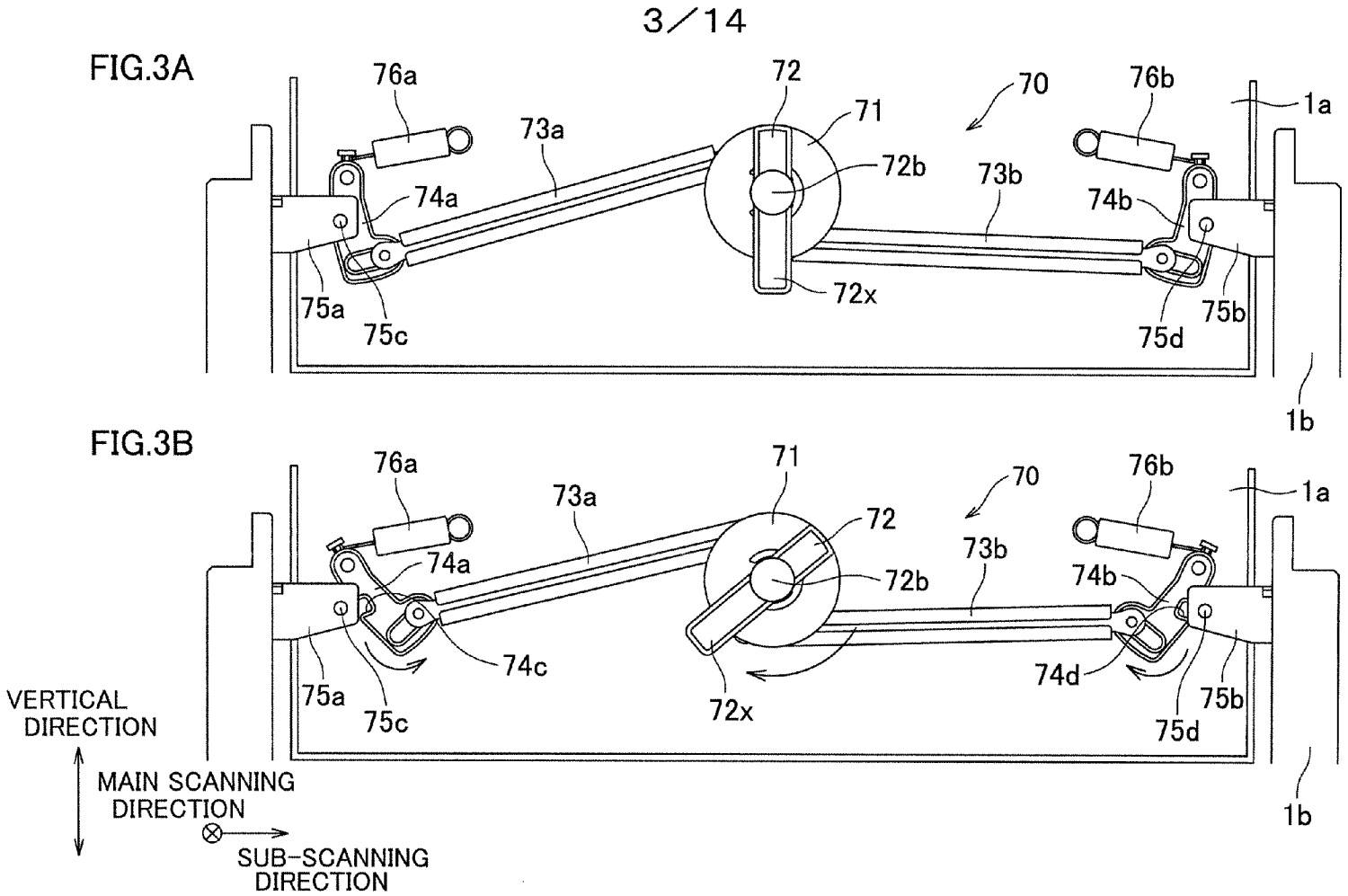
FIG. 3A is an elevation view of a locking mechanism, showing the state in which the movement of an upper housing is restricted by me locking mechanism.
FIG. 3B is an elevation view of the locking mechanism, showing that the restriction of the movement of the upper housing by the locking mechanism has been released.

Now, referring to FIG. 3A and FIG. 3B, the details of the locking mechanism 70 will be given.

The locking mechanism 70 includes a cylindrical rotating member 71, two interlocking members 73*a* and 73*b*, two swing members 74*a* and 74*b*, two springs 76*a* and 76*b*, and two fixing members 75*a* and 75*b*. An end of each of the interlocking members 73*a* and 73*b* in the longitudinal direction is connected to the peripheral surface of the rotating member 71. The swing members 74*a* and 74*b* have concave portions 74*c* and 74*d* which are open in the directions away from the rotating member 71*a*, respectively. The fixing members 75*a* and 75*b* respectively have shaft members 75*c* and 75*d* which are capable of being inserted into the concave portions 74*c* and 74*d*, respectively. The swing shafts of the swing members 74*a* and 74*b* are fixed to the upper housing 1*a*. The springs 76*a* and 76*b* are fixed to the upper housing 1*a* at ends which are close to the rotating member 71*a*. The fixing members 75*a* and 75*b* are fixed to the lower housing 1*b*.

On the front surface of the rotating member 71 is fixed a stick-shaped knob 72. The knob 72 rotates together with the rotating member 71. The springs 76*a* and 76*b* bias the upper ends of the swing members 74*a* and 74*b* toward the rotating member 71. With the arrangement above, when no external force is applied, the members of the locking mechanism 70 are, as shown in FIG. 3A, in a static state while the knob 72 extends in the vertical direction. In this state, the concave portions 74*c* and 74*d* are engaged with the shaft members 75*c* and 75*d*, respectively. Because of this engagement, the movement, of the upper housing 1*a* is restricted so that the upper housing 1*a* at the close position do not rotate toward the separated position. As the user rotates the knob 72 clockwise against the biasing forces of the springs 76*a* and 76*b*, as shown in FIG. 3B, the concave portions 74*c* and 74*d* are disengaged from the shaft members 75*c* and 75*d*. With this, the restriction of the movement of the upper housing 1*a* is released. As the upper housing 1*a* is returned from the separated position to the close position, the concave portions 74*c* and 74*d* are engaged with the shaft members 75*c* and 75*d* again. With this, the movement of the upper housing 1*a* is restricted by the locking mechanism 70 again.

At a part of the swing member 74*a* which part defines the concave portion 74*c*, a lock sensor 70*s* (see FIG. 10) is provided. The lock sensor 70*s* outputs, to the controller 1*p*, an ON signal when the shaft member 75*c* is inserted into the concave portion 74*c* and an OFF signal when the shaft member 75*c* is not inserted into the concave portion 74*c*. The controller 1*p* determines that the upper housing 1*a* is at the close position when receiving the ON signal from the lock sensor 70*s*, and determines that the upper housing 1*a* is at the separated position when receiving the OFF signal from the lock sensor 70*s*.

Figure 4:
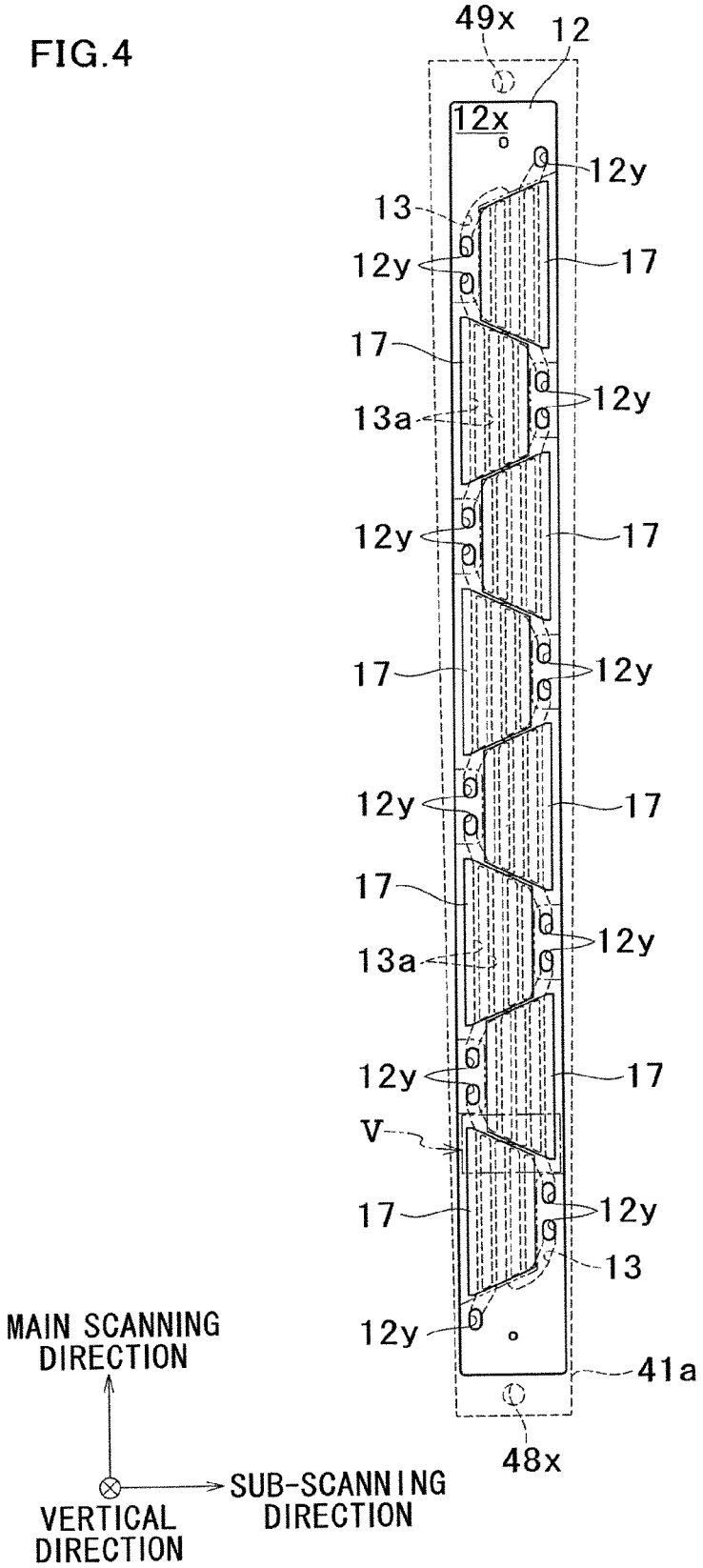
FIG. 4 is a plan view of a passage unit and an actuator unit of a head.
Figure 5:
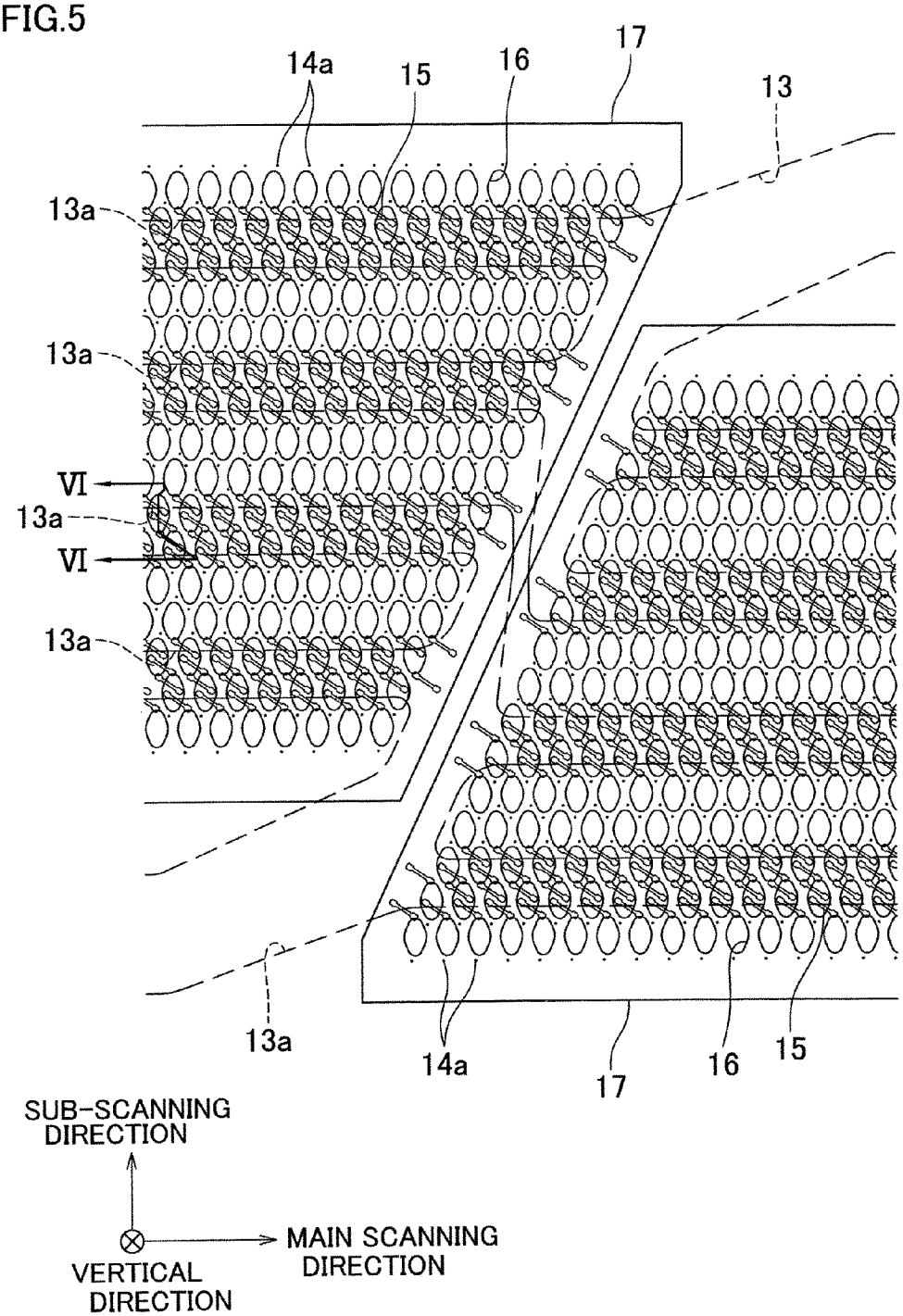
FIG. 5 is an enlarged view of the region V enclosed by the dashed line in FIG. 4.
Figure 6:
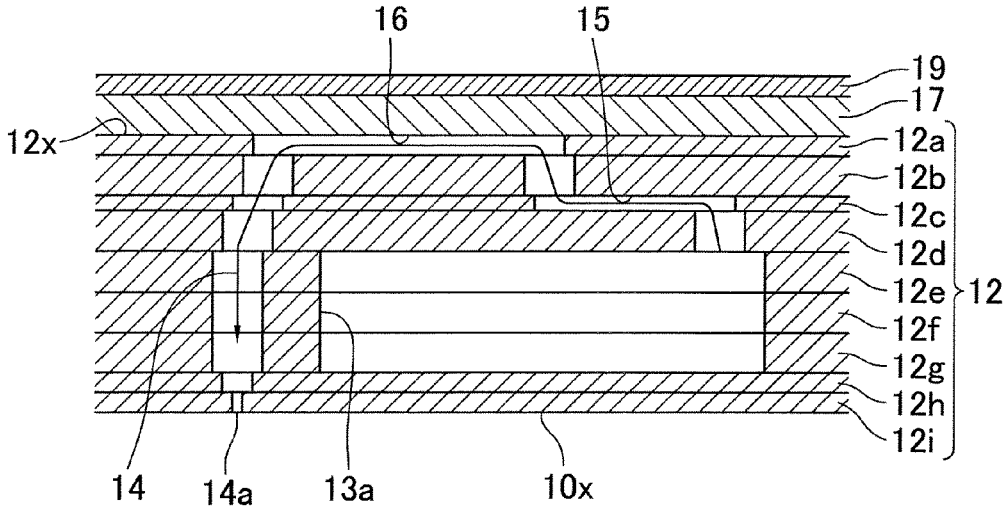
FIG. 6 is a partial cross section taken along the VI-VI line in FIG. 5.

Now, referring to FIG. 4 to FIG. 6, the arrangement of the heads 10*a* and 10*b* will be detailed.

Each of the heads 10*a* and 10*b* includes members such as a reservoir unit and a passage unit 12 which are vertically piled up, eight actuator units 17 fixed to the upper surface 12*x* of the passage unit 12, and an FPC (flat flexible circuit board) 19 connected to each actuator unit 17. In the reservoir unit, a passage including a reservoir which temporarily stores liquid supplied from the corresponding container of the cartridge 2 is formed. In the passage unit 12, a passage from the opening 12*y* of the upper surface 12*x* to each ejection opening 14*a* of the lower surface (ejection surface 10*x*) is formed. The actuator unit 17 includes a piezoelectric actuator for each ejection opening 14*a*.

The lower surface of the reservoir unit has concaves and protrusions. Each of the protrusions is adhered to a region (enclosed by a two-dot chain line and including an opening 12*y* shown in FIG. 4) which is on the upper surface 12*x* of the passage unit 12 and where no actuator unit 17 is disposed. The leading end surface of the protrusion has an opening which is connected to the reservoir and opposes each opening 12*y* of the passage unit 12. With this, the reservoir is connected to individual passages 14 via each opening above. The concave portion opposes the upper surface 12*x* of the passage unit 12, the surface of the actuator unit 17, and the surface of the FPC 19, with a slight gap being formed therebetween.

The passage unit 12 is a laminated body formed by laminating nine rectangular metal plates 12*a*, 12*b*, 12*c*, 12*d*, 12*e*, 12*f*, 12*g*, 12*h*, and 12*i* which are substantially identical in size and by adhering the plates with one another (see FIG. 6). The passage in the passage unit 12 includes a manifold passage 13 having an opening 12*y* at one end, a sub-manifold passage 13*a* branching from the manifold passage 13, and an individual passage 14 which connects the outlet of the sub-manifold passage 13*a* with the ejection opening 14*a* via the pressure chamber 16. The individual passage 14 is formed for each ejection opening 14*a* and includes an aperture 15 which is an aperture for adjusting the flow resistance. At the region on the upper surface 12*x* to which region each actuator unit 17 is adhered, substantially diamond-shaped openings are formed in a matrix manner to expose the pressure chambers 16. At a region on the lower surface (ejection surface 10*x*) which region opposes the region to which each actuator unit 17 is adhered, ejection openings 14*a* are formed in a matrix manner and in the same arrangement as the pressure chambers 16.

In connection with the above, in FIG. 5, the pressure chambers 16 and the apertures 15 are depicted by full lines even if they are underneath the actuator unit 17.

The actuator units 17 are each trapezoidal in plan view and are staggered on the upper surface 12*x* of the passage unit 12 to form two lines. Each actuator unit 17 covers a plurality of openings of the pressure chambers 16, which are formed in the region where the actuator unit 17 is adhered. Although not illustrated, the actuator unit 17 is constituted by a piezoelectric layer, a diaphragm, a common electrode, and individual electrodes. Among these members, the piezoelectric layer, the diaphragm, and the common electrode are all trapezoidal and sized to define the outer shape of the actuator unit 17. The individual electrodes are provided for the respective pressure chambers 16 and are disposed on the upper surface of the piezoelectric layer to oppose the respective pressure chambers 16. The diaphragm is disposed between the common electrode and the passage unit 12. A part of the actuator unit 17 which part corresponds to each individual electrode functions as a piezoelectric actuator. Each actuator is independently deformable in response to the application of a voltage via the FPC 19. The actuator changes the capacity of the corresponding pressure chamber 16 to provide an energy to the liquid in the pressure chamber 16. With this, the liquid is ejected through the ejection opening 14*a*.

The FPC 19 is provided with a driver IC and wires which correspond to the respective electrodes of the actuator unit 17. The FPC 19 is fixed to the actuator unit 17 at one end and fixed to the control substrate of the head 10*a* or 10*b* at the other end. The control substrate adjusts a signal supplied from the controller 1*p* and inputs the adjusted signal to the driver IC via the wire of the FPC 19. The driver IC converts the signal input from the control substrate to a drive signal and sends the drive signal to each electrode of the actuator unit 17 via the wire of the FPC 19.

Now, referring to FIG. 7A to FIG. 9, the arrangement of the capping mechanism 40, the arrangement of the moisturizing unit 50, the arrangement of the wiper, unit 36, the operations in the maintenance, or the like will be described below.

The annular member 41 is connected with a plurality of gears 43 (see FIG. 9), and moves up or down as the gears 43 are rotated by an annular member elevating motor 41M (see FIG. 11) under the control of the controller 1*p*.

The opposing member 42 is connected to the opposing member elevating motor 42M (see FIG. 11) and moves up or down by the opposing member elevating motor 42M under the control of the controller 1*p*. The opposing member 42 takes one of a first position, a second position, a third position, and a fourth position (see FIG. 7A and FIG. 7B). The first position is the highest, the second position is the second highest, the third position is the third highest, and the fourth position is the lowest.

The opposing member 42 is at the first position when the capping or flushing is conducted. The opposing member 42 is at the second position when the opposing surface 42*a* (which is the surface of the opposing member 42 and opposes the ejection surface 10*x* when the platens 6*a* and 6*b* are at the open position) is wiped. The opposing member 42 is at the third position when the wiping or purging of the ejection surface 10*x* is conducted. The opposing member 42 is at the fourth position when the recording is conducted or the apparatus is on standby. The separation distance between the opposing surface 42*a* and the ejection surface 10*x* when the opposing member 42 is at the first position is identical with the separation distance between the supporting surface 5*a* and the ejection surface 10*x* at the time of the recording.

Figure 7A:
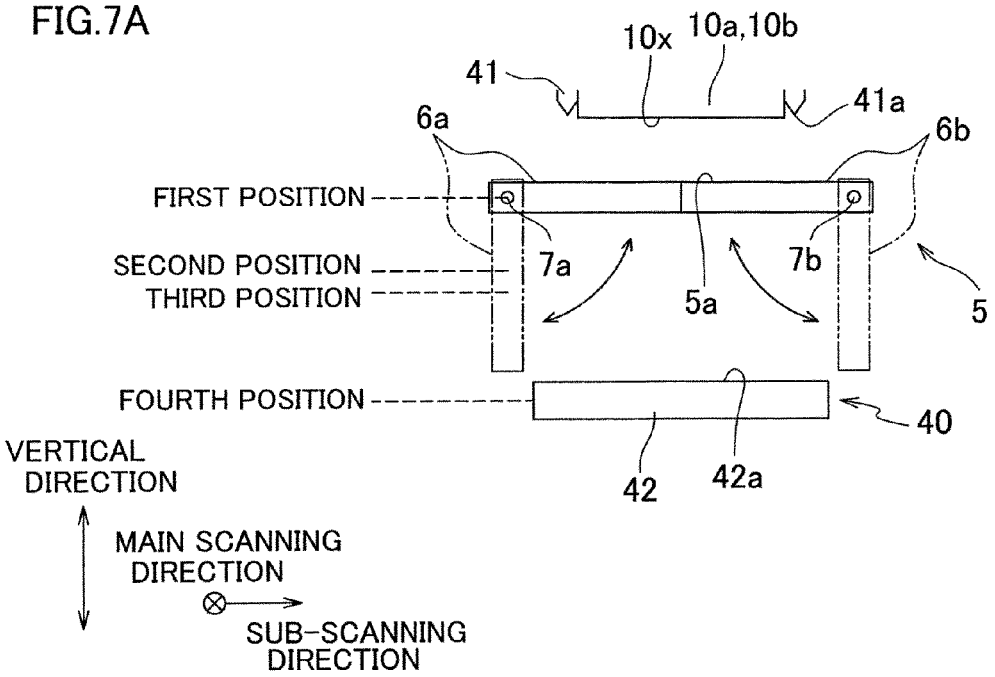
FIG. 7A and FIG. 7B illustrate the operations of a capping mechanism and a supporting mechanism.
Figure 7B:
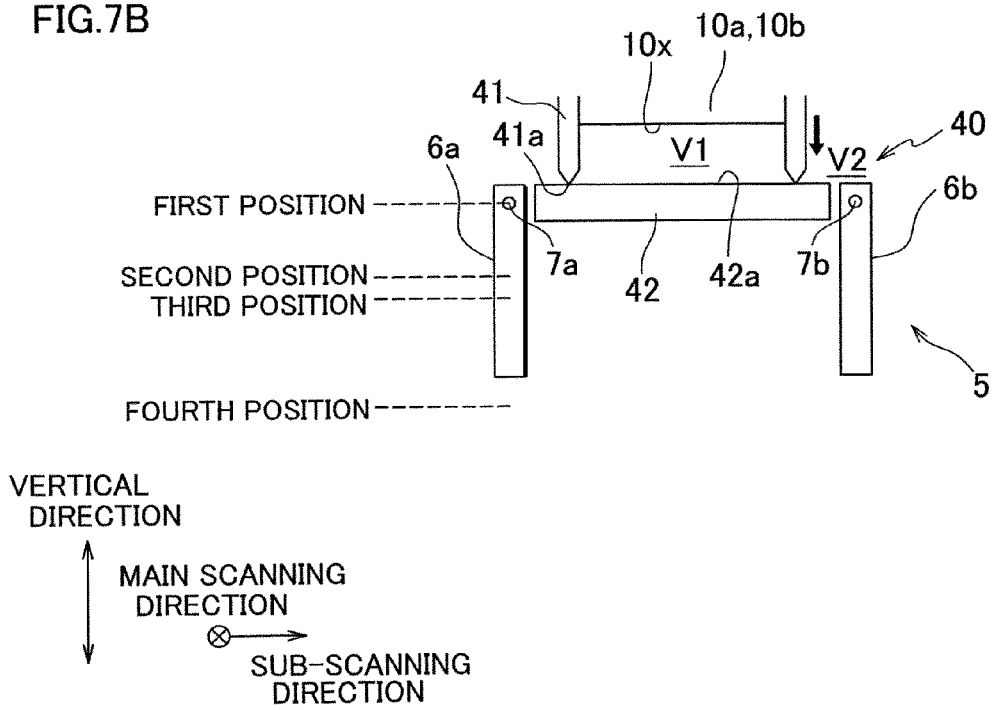

The capping mechanism 40 selectively takes a capped state (see FIG. 7B and FIG. 9) or an uncapped state (see (FIG. 2 and FIG. 7A). In the capped state, the ejection space V1 opposing the ejection surface 10*x* of the corresponding head 10*a* or 10*b* is covered, and separated from the space V2 which surrounds the ejection space V1. At the uncapped state, the ejection space V1 opposing the ejection surface 10*x* of the corresponding head 10*a* or 10*b* is not covered, and open to the space V2 surrounding the ejection space V1. The capping is an operation to maintain the capping mechanism 40 to be in the capped state. To change the state of the capping mechanism 40 to the capped state, as shown in FIG. 7B, the controller 1*p* moves down the annular member 41 while the supporting mechanism 5 is set at the open position and the opposing member 42 is set at the first position. As a result, the leading end 41*a* of the annular member 41 contacts the opposing surface 42*a* and hence the closed ejection space V1 is formed between the opposing surface 42*a* and the ejection surface 10*x*. The capping is conducted when, for example, no recording command is received for at least a predetermined time. By the capping, the drying of the ejection space V1 is prevented and the increase in the viscosity of the liquid in the ejection opening 14*a* is restrained.

The capping mechanism 40 is able to take the capped state when the upper housing 1*a* is at the close position, but cannot take the capped state and takes the uncapped state when the upper housing 1*a* is at the separated position.

The flushing is an operation to discharge liquid through the ejection opening 14*a* by driving the actuator unit 17 based on flushing data which is different from recording data (image data). The purging is an operation to discharge liquid through the ejection opening 14*a* by supplying the liquid to the head 10*a* or 10*b* by using a pump 2Pa, 2Pb (see FIG. 11) and then applying a pressure to the liquid in the head 10*a* or 10*b*. The flushing and the purging are carried out when, for example, no liquid is ejected from the ejection opening 14*a* at least for a predetermined time (this predetermined time may be different between the flushing and the purging) or the uncapped state is established during the moisturization operation as described later. By the flushing or the purging, liquid with increased viscosity in the ejection opening 14*a* and liquid contaminated with foreign matters (dust, bubbles or the like) are discharged and the ejection properties are restored.

When the flushing is conducted, the controller 1*p* sets the supporting mechanism 5 at the open position and sets the opposing member 42 at the first position, and drives the actuator unit 17 of the head 10*a* or 10*b* while the leading end 41*a* of the annular member 41 is positioned either at the same height as the ejection surface 10*x* or vertically above the ejection surface 10*x*. When the purging is conducted, the controller 1*p* sets the supporting mechanism 5 at the open position and sets the opposing member 42 at the third position, and drives the pump 2Pa, 2Pb while the leading end 41*a* of the annular member 41 is either at the same height as the ejection surface 10*x* or vertically above the ejection surface 10*x*. The liquid discharged on account of the flushing or the purging is received by the opposing surface 42*a*.

The wiping is an operation to remove a foreign matter on a target by causing a wiper to contact the target and moving the wiper relative to the target. The wiping is conducted by using a wiper unit 36 (see FIG. 8A to FIG. 8C). There are two types of the wiping, namely, the wiping of the ejection surface 10*x* and the wiping of the opposing surface 42*a*. For example, the wiping of the ejection surface 10*x* is conducted after the completion of the purging, whereas the wiping of the opposing surface 42*a* is conducted after the wiping of the ejection surface 10*x* after the completion of the purging, and also after the completion of the flushing.

The wiper unit 36 includes two wipers 36*a* and 36*b* and a base portion 36*c* supporting the wipers 36*a* and 36*b*. The wipers 36*a* and 36*b* are both plate-shaped members made of an elastic member (such as rubber), and protrude upward and downward from the upper surface and the lower surface of the base portion 36*c*, respectively. In the sub-scanning direction, the wiper 36*a* is slightly longer than the length of the ejection surface 10*x* and the wiper 36*b* is slightly longer than the length of the opposing surface 42*a*. The base portion 36*c* is connected to a wiper drive motor 36M (see FIG. 10), and is able to be reciprocated in the main scanning direction along the guide hole 36*g* by the wiper drive motor 36M under the control of the controller 1*p*. The home position of the base portion 36*c* is to the left of the heads 10*a* and 10*b* in FIG. 8A (i.e., the position where the base portion 36*c* is provided in FIG. 8A).

Figure 8B:
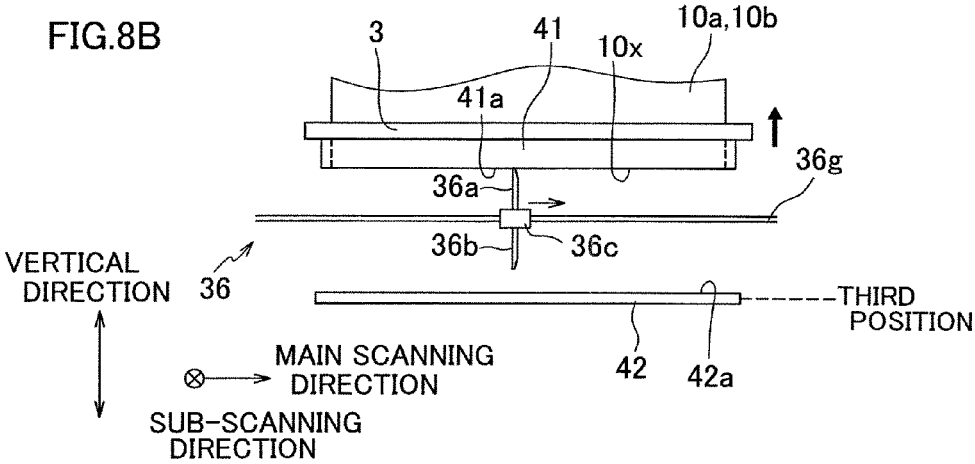
FIG. 8B and FIG. 8C illustrate wiping.
Figure 10:
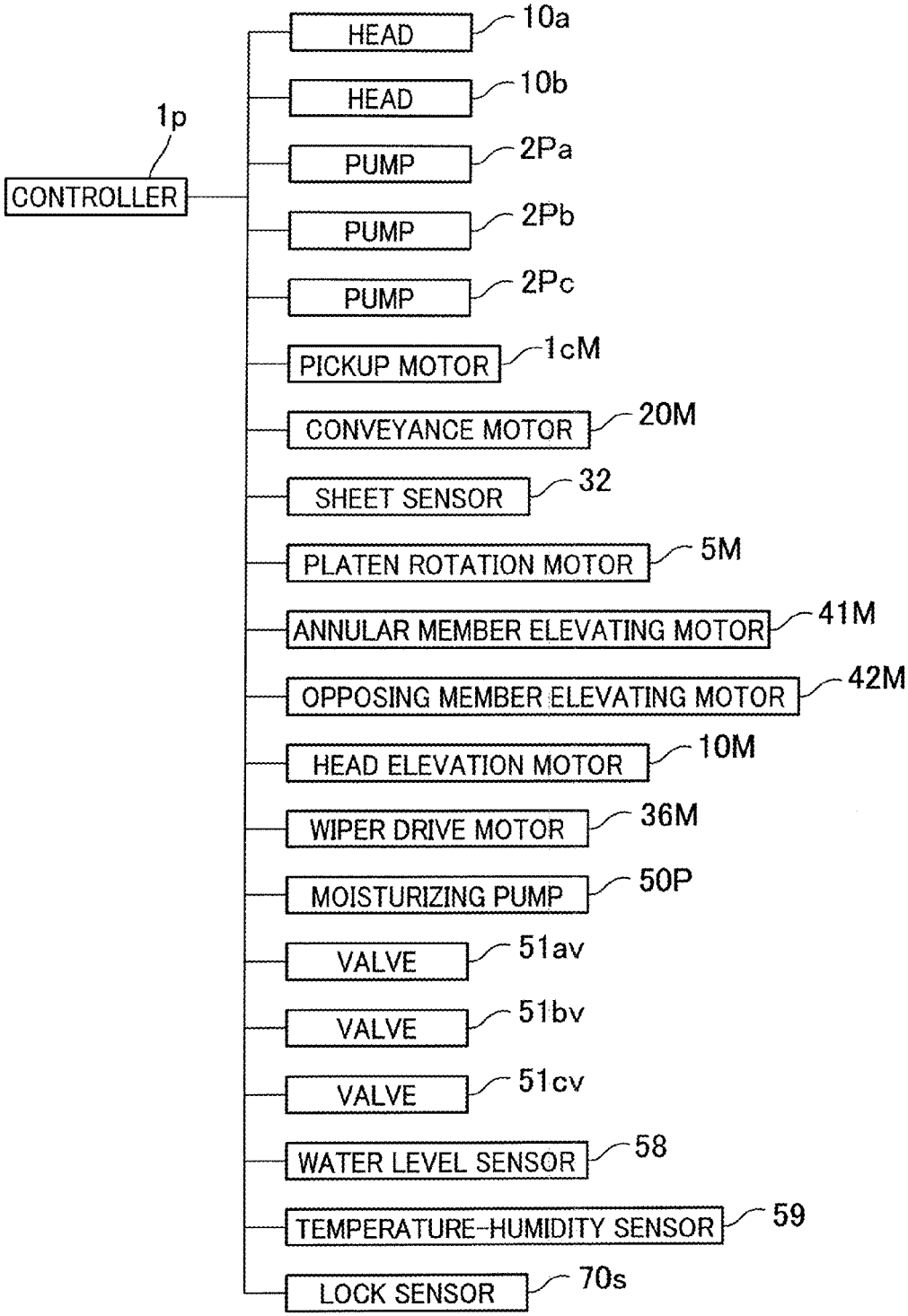
FIG. 10 is an oblique perspective of a tank in a moisturizing unit.

When the wiping of the ejection surface 10*x* is conducted, as shown in FIG. 8B, the controller 1*p* moves up the heads 10*a* and 10*b* together with the holder 3 by driving a head elevation motor 10M (see FIG. 10). The controller 1*p* then positions the supporting mechanism 5 at the open position and positions the opposing member 42 at the third position, and drives the wiper drive motor 36M while the leading end 41*a* of the annular member 41 is at the same height as the ejection surface 10*x* or vertically above the ejection surface 10*x*. With this, the base portion 36*c* moves rightward in FIG. 8B from the home position and a part of the wiper 36*a* around its leading end moves relative to the ejection surface 10*x* while contacting the ejection surface 10*x*. As a result, foreign matters on the ejection surface 10*x* are removed. To conduct the wiping of the opposing surface 42*a* subsequent to the wiping of the ejection surface 10*x*, the controller 1*p* causes the base portion 36*c* to be on standby at a position to the right of the heads 10*a* and 10 *b* in FIG. 8B.

Figure 8C:
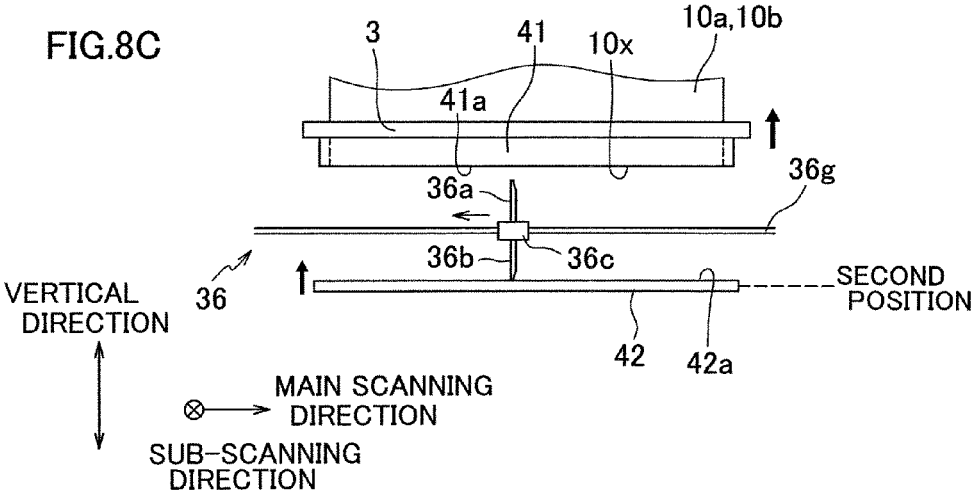

To conduct the wiping of the opposing surface 42*a*, as shown in FIG. 8C, the controller 1*p* moves up the heads 10*a* and 10*b* together with the holder 3 by driving a head elevation motor 10M (see FIG. 10), so as to position the heads 10*a* and 10*b* to be vertically above the position in the wiping of the ejection surface 10*x* shown in FIG. 8B. The controller 1*p* then positions the supporting mechanism 5 at the open position and positions the opposing member 42 at the second position, and drives the wiper drive motor 36M while the leading end 41*a* of the annular member 41 is at the same height as the ejection: surface 10*x* or is vertically above the ejection surface 10*x*. With this, a part of the wiper 36*b* around its leading end moves relative to the opposing surface 42*a* while contacting the opposing surface 42*a*. As a result, foreign matters on the opposing surface 42*a* are removed.

To conduct the wiping of the opposing surface 42*a* subsequent to the wiping of the ejection surface 10*x*, the controller 1*p* moves the base portion 36*c* leftward as shown in FIG. 8C and stops it at the home position. With this movement, the opposing surface 42*a* is wiped. On the other hand, in cases other than the above, the controller 1*p* moves the base portion 36*c* rightward from the home position in FIG. 8C and stops it at a position to the right of the heads 10*a* and 10*b*. With this movement, the opposing surface 42*a* is wiped. After moving the opposing member 42 to the fourth position, the controller 1*p* moves the base portion 36*c* leftward in FIG. 8C and stops it at the home position.

The moisturization operation is an operation to moisturize the ejection space V1 by driving a moisturizing pump 50P (see FIG. 9) of the moisturizing unit 50 while keeping the capping mechanism 40 to take the capped state. By the moisturization operation, moisturized air is supplied into the ejection space V1 and hence the increase in the viscosity of the liquid in the ejection opening 14*a* is restrained.

The moisturizing unit 50 includes a tank 51 which stores moisturizing liquid, two tubes 52*a*, two tubes 52*c*, and a moisturizing pump 50P. Each of the two tubes 52*a* connects the tank 51 with a joint 48 of the head 10*a* or 10*b*, and has an outflow path 52*af* therein. The outflow path 52*af* is connected to a space 51V in the tank 51, and is connected to the ejection space V1 when the capping mechanism 40 is in the capped state. Air flowing out from the ejection space V1 passes through the outflow path 52*af*. Each of the two tubes 52*c* connects the tank 51 with a joint 49 of the head 10*a* or 10*b* and has an inflow path 52*cf* therein. The inflow path 52*cf* is connected to the space 51V, and is connected to the ejection space V1 when the capping mechanism 40 is in the capped state. Air flowing towards the ejection space V1 passes through the inflow path 52*cf*. The two joints 48 and 49 are provided for each of the heads 10*a* and 10*b*, and are disposed at one end and the other end of each of the heads 10*a* and 10*b* in the main scanning direction. The joints 48 and 49 are attached to the annular member 41. Each of the joints 48 and 49 is substantially cylindrical and connects the ejection space V1 with the space surrounding the ejection space V1 by the internal space of the same. The moisturizing pump 50P is disposed on a non-edge part of each tube 52*c*.

On the upper surface of the tank 51 is provided protruding portions 51*a*, 51*b*, and 51*c* which are cylindrical in shape and protrude upward. At the leading ends of the two protruding portions 51*a*, the tubes 52*a* are attached, respectively. At the leading ends of the two protruding portions 51*c*, the tubes 52*c* are attached, respectively. The proximal ends of the protruding portions 51*a* and 51*c* are open to the space 51V via through holes made through the upper wall of the tank 51. The protruding portion 51*b* is connected to a cylindrical member 51*b*2 which protrudes downward in the tank 51. The internal spaces of the protruding portion 51*b* and the cylindrical member 51*b*2 are connected with each other via a through hole made through the upper wall of the tank 51, so as to form an atmosphere connection path 51*bf* which connects the space 51V with the atmosphere.

Around the protruding portion 51*a* of each tube 52*a* is provided a valve 52*av* which opens or closes the outflow path 52*af*. Around the protruding portion 51*c* of each tube 52*c* is provided a valve 52*cv* which opens or closes the inflow path 52*cf*. Around the upper end of the protruding portion 51*b* is provided a valve 51*bv* which opens or closes the atmosphere connection path 51*bf*. These valves 51*bv*, 52*av*, and 52*cv* are opened or closed under the control of the controller 1*p*.

Figure 9:
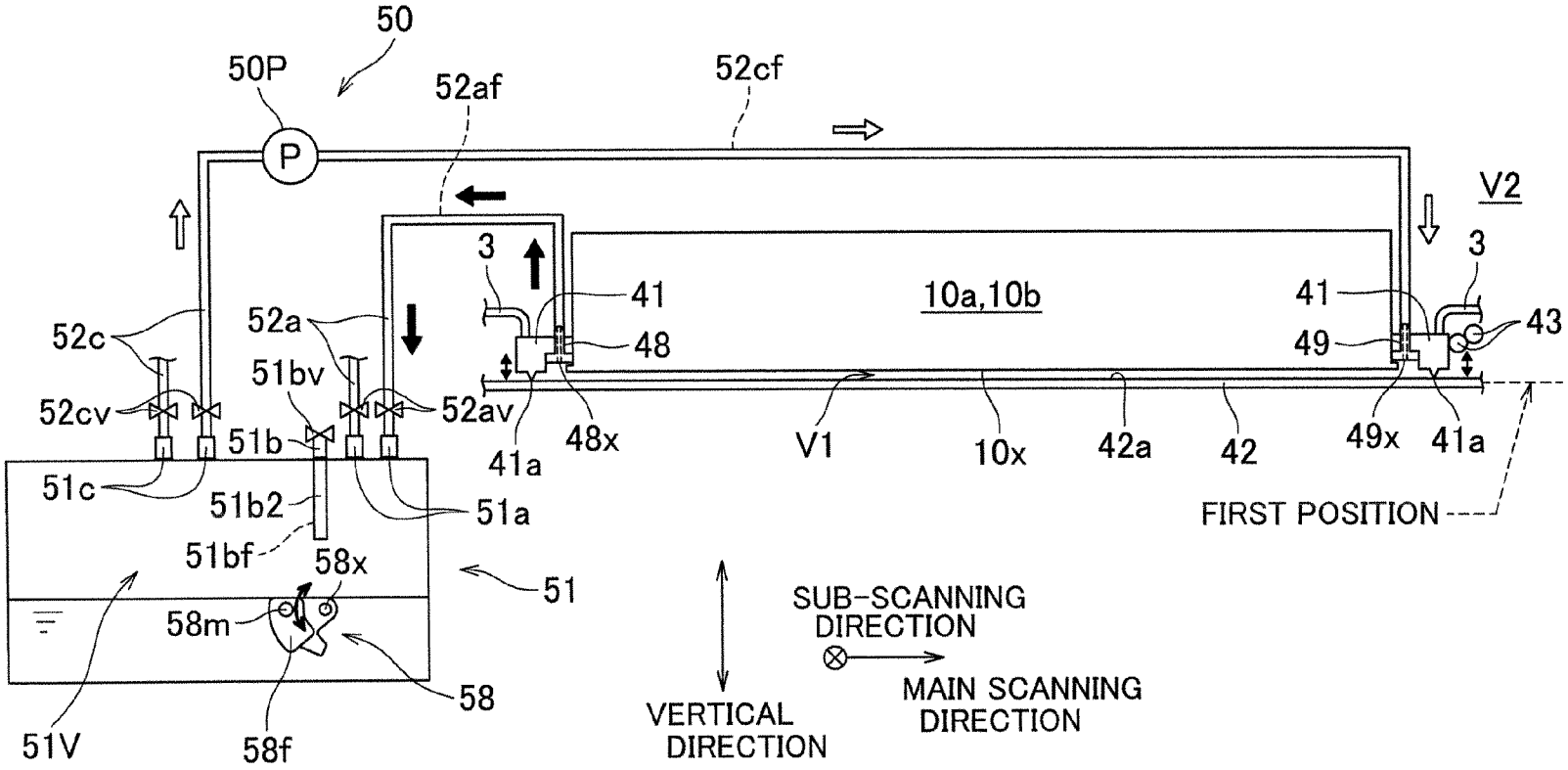
FIG. 9 illustrates a moisturization operation.

To conduct the moisturization operation, the controller 1*p* sets the capping mechanism 40 in the capped state and drives the moisturizing pump 50P while keeping the valves 51*bv*, 52*av*, and 52*cv* to be open. As a result, the air in the ejection space V1 is collected through an opening 48*x* on the lower surface of the joint 48, passes through the outflow path 52*af* in the tube 52*a*, and eventually flows into the space 51V. The air having flown into the space 51V is moisturized by (the natural evaporation of) the moisturizing liquid stored in the space 51V, and then passes through the inflow path 52*cf* in the tube 52*c* and reaches the ejection space V1 via an opening 49*x* on the lower surface of the joint 49. In FIG. 9, black arrows indicate the flow of air before the moisturization, whereas outline arrows indicate the flow of air after the moisturization.

The tank 51 is provided with a water level sensor 58 which detects the water level of moisturizing liquid. The water level sensor 58 includes a float 58*f* and a magnetic sensor (not illustrated) which detects the existence of a magnet 58*m* fixed to the float 58*f*. The float 58*f* is swingable about a shaft 58*x* fixed to a side wall of the tank 51. As air is enclosed therein, the float 58*f* swings to follow the movement of the surface of the moisturizing liquid. The magnetic sensor detects whether the position of the magnet 58*m* is at the position indicating the maximum water level of the tank 51. Before conducting the moisturization operation, based on a detection signal from the water level sensor 58, the controller 1*p* drives a pump 2Pc (see FIG. 10) to supply the moisturizing liquid from the moisturizing liquid container of the cartridge 2 to the space 51V so that the water level of the moisturizing liquid stored in the space 51V is at the maximum (as shown in FIG. 9), when the moisturizing liquid stored in the space 51V is not at the maximum water level.

Figure 11:
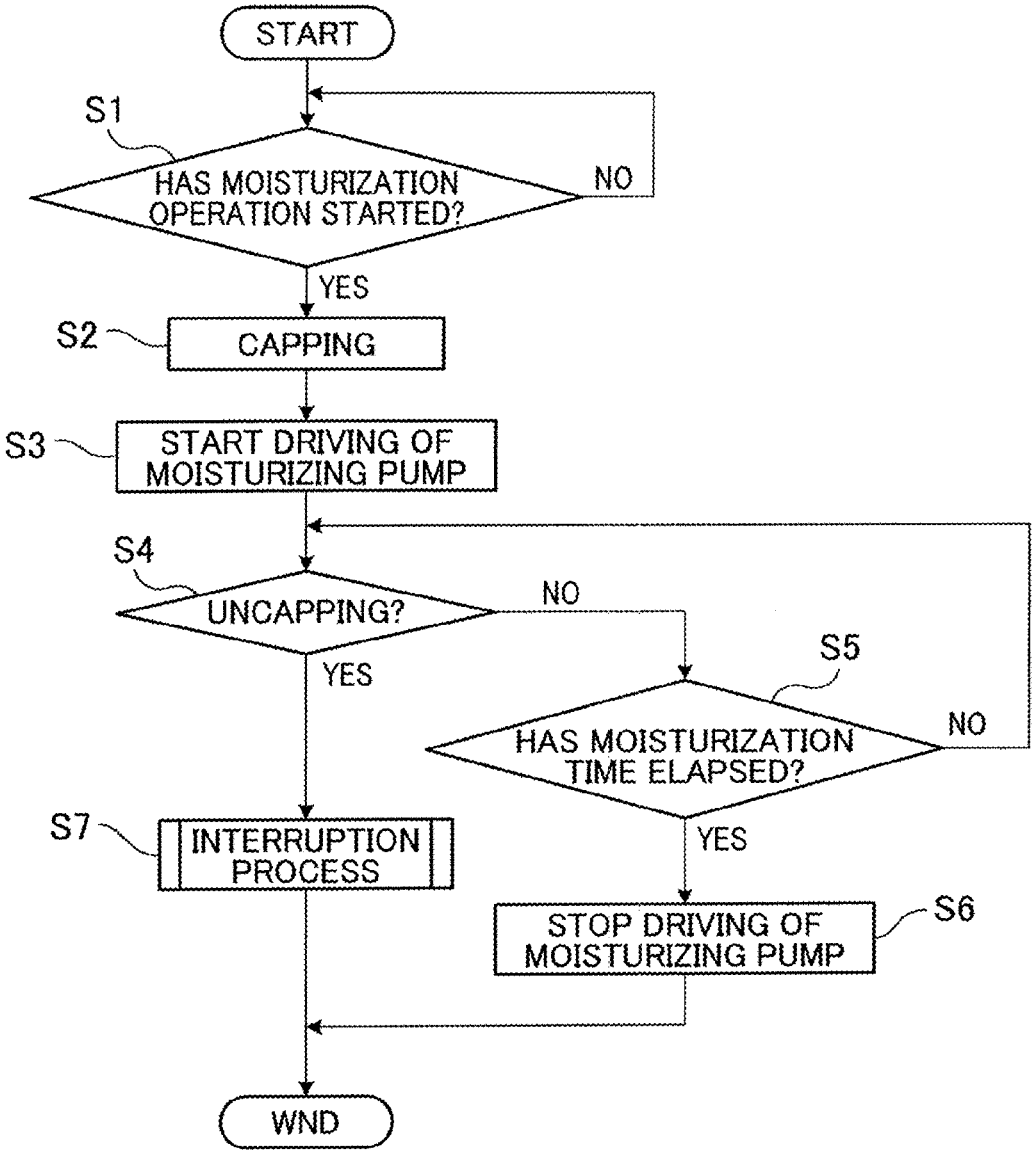
FIG. 11 is a flowchart of the control of the moisturization operation performed by a controller.
Figure 12:
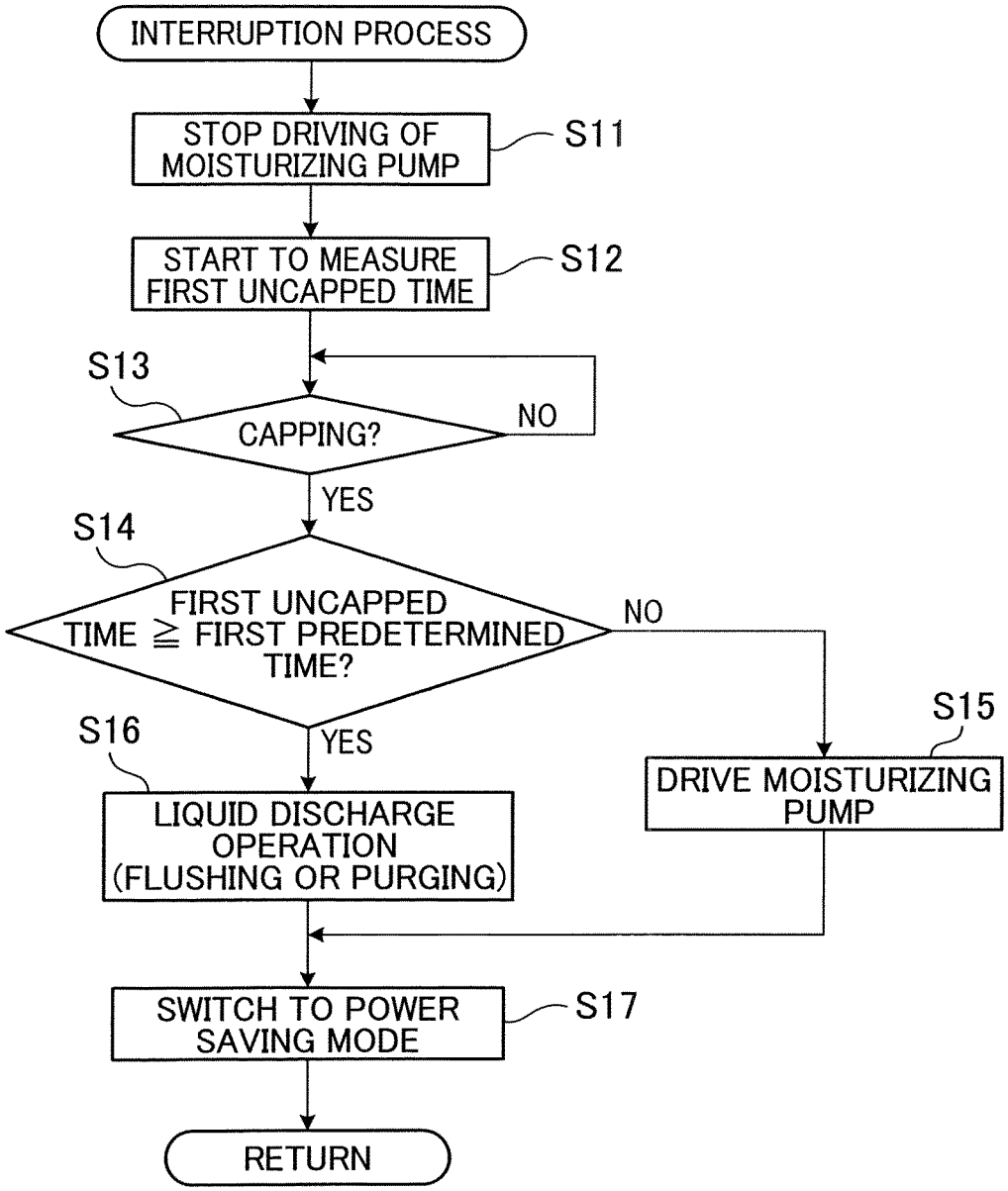
FIG. 12 is a flowchart showing the control concerning the interruption process shown in FIG. 11.

Now, referring to FIG. 11 and FIG. 12, the control concerning the moisturization operation, which is executed by the controller 1*p*, will be described.

To begin with, the controller 1*p* determines whether to start a moisturization operation (S1). When a recording command is not received at least for a predetermined time, the controller 1*p* starts the moisturization operation. To start the moisturization operation (S1: YES), the controller 1*p* causes the capping mechanism 40 to take the capped state (S2), and then starts to drive the moisturizing pump 50P (S3). Thereafter, the controller 1*p* determines whether the state of the capping mechanism 40 has been changed to the uncapped state (i.e., whether a first change has been detected) (S4). The controller 1*p* makes this determination based on a signal supplied from the lock sensor 70*s*.

The upper housing 1*a* is arranged to be movable with respect to the lower housing 1*b*, no matter whether the moisturizing pump 50P is driven. On this account, there is a possibility that the user moves the upper housing 1*a* from the close position to the separated position while the air moisturized in the tank 51 is being supplied to the ejection space V1 by the moisturizing pump 50P. In such a case, as the upper housing 1*a* moves from the close position to the separated position, the state of the capping mechanism 40 is changed from the capped state to the uncapped state (first change). Thereafter, when the user moves the upper housing 1*a* from the separated position to the close position, the state of the capping mechanism 40 is changed from the uncapped state to the capped state (second change). The controller 1*p* detects such a change in the state of the capping mechanism 40 based on a signal supplied from the lock sensor 70*s*. That is to say, when the signal from the lock sensor 70*s* is changed from the ON signal to the OFF signal, the controller 1*p* determines that the state of the capping mechanism 40 is changed from the capped state to the uncapped state, and when the signal from the lock sensor 70*s* is changed from the OFF signal to the ON signal, the controller 1*p* determines that the state of the capping mechanism 40 is changed from the uncapped state to the capped state.

When the capping mechanism 40 is not in the uncapped state (S4; NO), the controller 1*p* determines whether a predetermined moisturization time has elapsed after the start of the driving of the moisturizing pump 50P in S3 (S5). When the moisturization time has not elapsed (S5: NO), the controller 1*p* restarts the routine from S4. When the moisturization time has elapsed (S5: YES), the controller 1*p* stops the driving of the moisturizing pump 50P (S6), and then ends the routine. The moisturization time is measured by using an internal timer or the like.

When the capping mechanism 40 is in the uncapped state (S4: YES), the controller 1*p* executes an interruption process (S7) and then ends the routine.

In the interruption process, the controller 1*p* stops the driving of the moisturizing pump 50P (S11) and then starts to measure a first uncapped time by using an internal timer (S12). The first uncapped time is a time measured from a point of time at which the state of the capping mechanism 40 is changed from the capped state to the uncapped state while the air moisturized by the tank 51 is being moved to the ejection space V1 by the moisturizing pump 50P (i.e., a point of time at which the determination in S4 is made to be YES) to a point of time at which the state of the capping mechanism 40 is returned from the uncapped state to the capped state (i.e., a point of time at which the determination in S13 is made to be YES).

After S12, the controller 1*p* determines whether the capping mechanism 40 becomes in the capped state (S13). In so doing, in the same manner as S3, the controller 1*p* makes the determination based on a signal from the lock sensor 70*s*. When the capping mechanism 40 is in the capped state (S13: YES), the controller 1*p* determines whether the first uncapped time is not shorter than a first predetermined time (S14).

When the first uncapped time is shorter than the first predetermined time (S14: NO), the controller 1*p* controls the moisturizing pump 50P to move the air moisturized by the tank 51 to the ejection space V1 (S15), and then proceeds to S17.

In S15, based on the first uncapped time and a signal from a temperature-humidity sensor 59 (see FIG. 10), the controller 1*p* determines the time length of driving the moisturizing pump 50P and drives the moisturizing pump 50P for the determined time length. The temperature-humidity sensor 59 outputs a signal relative to the temperature and humidity in the ejection space V1, and is disposed in the vicinity of the ejection space V1 (e.g., on an inner wall of the annular member 41). For example, the controller 1*p* drives the moisturizing pump 50P for a time length calculated by adding the first uncapped time and a time based on a signal from the temperature-humidity sensor 59 to the remaining moisturization time. The remaining moisturization time is calculated by subtracting, from a predetermined moisturization time, the time during which the moisturizing pump 50P is driven before the state of the capping mechanism 40 becomes the uncapped state (i.e., the time between the time point of S3 and the time point at which the determination in S4 is made to be YES).

Before S15, the controller 1*p* controls the members so that a liquid discharge operation (flushing or purging) is conducted. In so doing, based on the first uncapped time and a signal from the temperature-humidity sensor 59, the controller 1*p* determines an amount of liquid to be discharged and controls the actuator unit 17 in the case of flushing or controls the pumps 2Pa and 2Pb in the case of purging, so that the determined amount of liquid is discharged.

When the first uncapped time is equal to or longer than the first predetermined time (S14: YES), the controller 1*p* controls the members so that the liquid discharge operation (flushing or purging) is conducted (S16), and then proceeds to S17. In S16, based on the first uncapped time and a signal from the temperature-humidity sensor 59, the controller 1*p* determines an amount of liquid to be discharged and controls the actuator unit 17 in the case of flushing or controls the pumps 2Pa and 2Pb in the case of purging, so that the determined amount of liquid is discharged.

In S15, in the liquid discharge operation before S15, and in S16, the controller 1*p* may elongate the driving time of the moisturizing pump 50P or increase the amount of liquid to be discharged, in proportion to the increase in the length of the first uncapped time, the increase in the temperature of the ejection space V1, or the decrease in the humidity in the ejection space V1. Which one of flushing and purging is conducted in the liquid discharge operation may be determined based on the amount of liquid to be discharged. The amount of liquid discharged in the liquid discharge operation may be adjusted based on the frequency of the flushing, the frequency of the purging, or the like.

In S17, the controller 1*p* switches the driving mode of the moisturizing pump 50P from a normal mode to a power saving mode with which the power consumption is restrained as compared to the normal mode. In so doing, the controller 1*p* turns off the power of the control substrate of the moisturizing pump 50P to eliminate the standby current. The driving mode of the moisturizing pump 50P is maintained to be the power saving mode after S17 until the next moisturization operation is conducted. Before the moisturizing pump 50P is driven in the next moisturization operation, the driving mode is switched from the power saving mode to the normal mode. When switching the driving mode of the moisturizing pump 50P from the power saving mode to the normal mode, the controller 1*p* turns on the power of the control substrate of the moisturizing pump 50P.

After S17, the controller 1*p* ends the routine.

Figure 13:
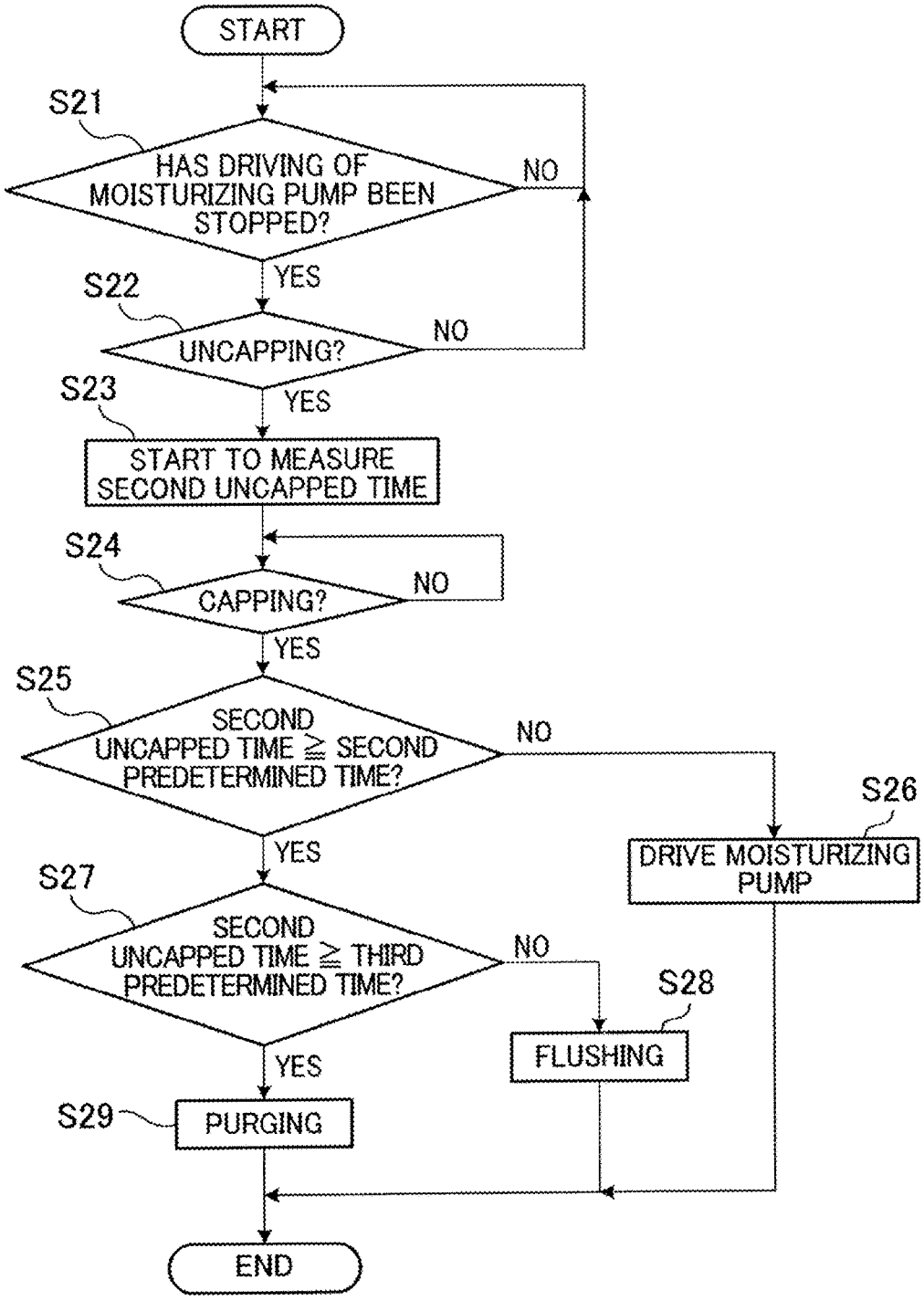
FIG. 13 is a flowchart showing the control executed by the controller, while the moisturization operation is under suspension.

Now, referring to FIG. 13, the control by the controller 1*p* while the moisturization operation is under suspension will be described.

To begin with, the controller 1*p* determines whether the driving of the moisturizing pump 50P is under suspension (S21). When the driving of the moisturizing pump 50P is under suspension (S21: YES), the controller 1*p* determines whether the state of the capping mechanism 40 has been changed from the capped state to the uncapped state (S22). In so doing, in the same manner as S3, the controller 1*p* makes the determination based on a signal from the lock sensor 70*s*. When the start of the capping mechanism 40 has not been changed from the capped state to the uncapped state (S22: NO), the controller 1*p* goes back to S21.

When the state of the capping mechanism 40 has been changed from the capped state to the uncapped state, (S22: YES), the controller 1*p* starts to measure a second uncapped time by using an internal timer (S23). The second uncapped time is a time length from a point of time at which the capping mechanism 40 is changed from the capped state to the uncapped state before the air moisturized by the tank 51 is moved to the ejection space V1 by the moisturizing pump 50P (i.e., a point of time at which the determination in S22 is made so as to be YES) to a time point at which the state the capping mechanism 40 is returned from the uncapped state to the capped state (i.e., a point of time at which the determination in S24 is made so as to be YES).

After S23, the controller 1*p* determines whether the state of the capping mechanism 40 has become the capped state (S24). In so doing, being identical with the S22, the controller 1*p* makes the determination based on a signal from the lock sensor 70*s*. When the state of the capping mechanism 40 has become the capped state (S24: YES), the controller 1*p* determines whether the second uncapped time is not shorter than the second predetermined time (S25).

When the second uncapped time is shorter than the second predetermined time (S25: NO), the controller 1*p* controls the moisturizing pump 50P so that the air moisturized by the tank 51 is moved to the ejection space V1 (S26), and then ends the routine.

When the second uncapped time is not shorter than the second predetermined time (S25: YES), the controller 1*p* determines whether the second uncapped time is not shorter than a third predetermined time (S27). When the second uncapped time is shorter than the third predetermined time (S27: NO), the controller 1*p* controls the members so that flushing is conducted (S28), and then ends the routine. When the second uncapped time is not shorter than the third predetermined time (S27: YES), the controller 1*p* controls the members so that purging is conducted (S29), and then ends the routine.

In S26, S28, and S29, the controller 1*p* may determine the driving time of the moisturizing pump 50P or the amount of liquid to be discharged, based on the second uncapped time and a signal from the temperature-humidity sensor 59.

As described above, in the printer 1 of the present embodiment, when the first uncapped time is relatively short (S14: NO). It is assumed that the state of the liquid in the ejection opening 14*a* is not significantly deteriorated. Based on this assumption, moist air is supplied to the ejection space V1 to restore or maintain the state of the liquid in the ejection opening 14*a* (S15). On the other hand. When the first uncapped time is relatively long (S14: YES), it is assumed that the state of the liquid in the ejection opening 14*a* is deteriorated and it takes time to restore or maintain the state only by the supply of moist air. With this assumption, the liquid is discharged from the ejection opening 14*a* (S16). As such, the maintenance of the heads 10*a* and 10*b* is efficiently carried out even if the state of the capping mechanism 40 is changed from the capped state to the uncapped state while moist air is being supplied to the ejection space V1.

Before S15, the controller 1*p* controls the actuator unit 17 and the pumps 2Pa and 2Pb so that the liquid, the amount of which has been determined based on the first uncapped time, is discharged from the ejection opening 14*a*. According to this arrangement, the maintenance in accordance with the state of the liquid in the ejection opening 14*a* is further ensured, and the state of the liquid in the ejection opening 14*a* is more certainly restored or maintained.

Furthermore, the amount of liquid discharged in the liquid discharge operation before S15 is determined based on not only the first uncapped time but also a signal from the temperature-humidity sensor 59. According to this arrangement, the maintenance in accordance with the state of the liquid in the ejection opening 14*a* is further ensured, and the state of the liquid in the ejection opening 14*a* is more certainly restored or maintained.

In S15, the controller 1*p* drives the moisturizing pump 50P for a time length determined based on the first uncapped time. According to this arrangement, the maintenance in accordance with the state of the liquid in the ejection opening 14*a* is further ensured, and the state of the liquid in the ejection opening 14*a* is more certainly restored or maintained.

Furthermore, the driving time of the moisturizing pump 50P in S15 is determined based on not only the first uncapped time but also a signal from the temperature-humidity sensor 59. According to this arrangement, the maintenance in accordance with the state of the liquid in the ejection opening 14*a* is further ensured, and the state of the liquid in the ejection opening 14*a* is more certainly restored or maintained.

In regard to the control while the moisturization operation is under suspension, when the second uncapped time is shorter than the second predetermined time (S25: NO), the controller 1*p* drives the moisturizing pump 50P (S26), when the second uncapped time is not shorter than the second predetermined time but shorter than the third predetermined time (S27: NO), the controller 1*p* controls the members so that flushing is conducted (S28), and when the second uncapped time is not shorter than the third predetermined time (S27: YES), the controller 1*p* controls the members so that purging is conducted (S29). According to this arrangement, even if the state of the capping mechanism 40 is changed from the capped state to the uncapped, state while moist air is not being supplied to the ejection space V1, the maintenance suitable for the state of the liquid in the ejection opening 14*a* is conducted, and hence the state of the liquid in the ejection opening 14*a* is certainly restored or maintained.

When the first uncapped time is not shorter than the first predetermined time (S14: YES), the controller 1*p* controls the members so that the liquid discharge operation is conducted (S16), and then switches the driving mode of the moisturizing pump 50P from the normal mode to the power saving mode (S17). This arrangement makes it possible to efficiently carry out the maintenance and achieve power saving. More specifically, because the liquid discharge operation typically takes a shorter time than the moisturization operation, power saving is achieved in a relatively short time when the first uncapped time is not shorter than the first predetermined time.

The capping mechanism 40 is able to take the capped state when the upper housing 1*a* is at the close position, and takes the uncapped state when the upper housing 1*a* is at the separated position. The upper housing 1*a* is arranged to be movable with respect to the lower housing 1*b* no mater whether the moisturizing pump 50P is driven. According to the arrangement above, the position of the upper housing 1*a* is not locked while the moisturizing pump 50P is being driven, and a suitable process (e.g., manual maintenance of the ejection surface 10*x*) can be done after moving the upper housing 1*a* from the close position to the separated position. The convenience for the user is therefore improved. In the case above, the state of the capping mechanism 40 is changed from the capped state to the uncapped state while the moisturizing pump 50P is being driven. The maintenance can be efficiently done even in such a case, according to me present embodiment.

The controller 1*p* stops the driving of the moisturizing pump 50P during a time from the time point of a change in the state of the capping mechanism 40 from the capped state to the uncapped state while the moisturizing pump 50P is being driven (S4: YES) to the time point of the return of the state of the capping mechanism 40 to the capped state (S13; YES). According to this arrangement, because the moisturization is not effectively done even if the moisturizing pump 50P is driven during the time above, the driving of the moisturizing pump 50P is stopped and power saving is therefore achieved.

Figure 14:
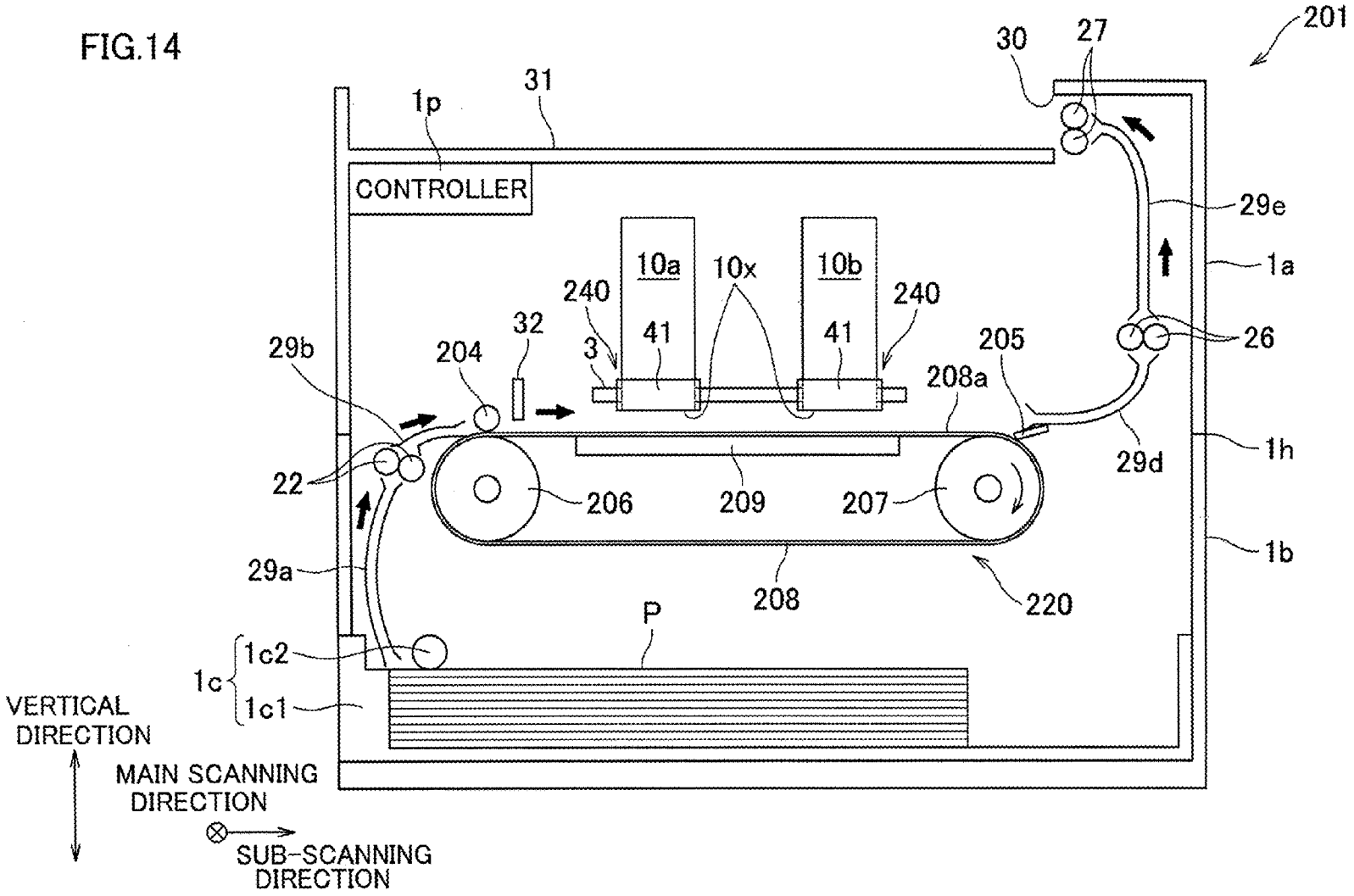
FIG. 14 is a schematic profile showing the internal structure of art inkjet printer of Second Embodiment of the present invention.

Now, referring to FIG. 14, an inkjet printer 201 of Second Embodiment of the present invention will be described. The printer 201 of the present embodiment is substantially identical with the printer 1 of First Embodiment except the structures of the conveying unit and the capping mechanism. Elements which are the same as those of First Embodiment are designated by the same reference numerals, and redundant descriptions thereof are omitted.

A conveying unit 220 of the present embodiment is identical with the conveying unit 20 of First Embodiment except that the supporting mechanism 5, the roller pairs 23, 24, and 25, the intermediate roller 21, and the guide 29*c* are omitted whereas belt rollers 206 and 207, a conveyance belt 208, a platen 209, a nipping roller 204, and a peeling plate 205 are added.

The conveyance belt 208 is an annular belt wrapping between the rollers 206 and 207. The belt roller 207 is a drive roller and is rotated clockwise in FIG. 14 by a conveyance motor 20M (see FIG. 10). As the belt roller 207 is rotated, the conveyance belt 208 moves in the direction indicated by thick arrows in FIG. 14. The belt roller 206 is a driven roller and is rotated clockwise in FIG. 14 as the conveyance belt 208 moves. The nipping roller 204 and the peeling plate 205 are disposed outside the conveyance belt 208. The nipping roller 204 is disposed to oppose the belt roller 206 over the conveyance belt 208. This nipping roller 204 presses a sheet P, which is conveyed while being guided by the guide 29*b*, onto the surface 208*a* of the conveyance belt 208 (i.e., the supporting surface supporting the sheet P). The peeling plate 205 is disposed to oppose the belt roller 207 over the conveyance belt 208. This peeling plate 205 peels off the sheet P from the supporting surface 208*a* and guides the sheet to the guide 29*d*. The platen 209 is disposed to oppose the ejection surfaces 10*x* of the two heads 10*a* and 10*b* and supports the upper loop of the conveyance belt 208 from inside.

The capping mechanism 240 of the present embodiment does not include the opposing member 42 of First Embodiment, and is constituted by the annular member 41 and the conveyance belt 208. When the state of the capping mechanism 240 is changed to the capped state, the controller 1*p* moves down the annular member 41 to cause the leading end of the annular member 41 to contact the supporting surface 208*a*. As a result, a closed ejection space V1 is formed between the supporting surface 208*a* and the ejection surface 10*x*.

As described above, the printer 201 of the present embodiment exerts the following effect in addition to the effects exerted by the arrangements identical with those of First Embodiment, because the state of the capping mechanism 240 is changed to the capped state as the leading end of the annular member 41 contacts the supporting surface 208*a* supporting the sheet P. That is to say, jamming treatment can be done by moving the upper housing 1*a* from the close position to the separated position even if the moisturizing pump 50P is being driven.

The liquid ejection apparatus is not limited to the printer but may be a facsimile machine, a photocopier, or the like. The housing of the liquid ejection apparatus is not necessarily composed of two, i.e., upper and lower housings. The housing may be a single housing. Also in this case, the ejection space may become open to the space surrounding the ejection space while moist air is being supplied to the ejection space, because, for example, the user opens a cover of the housing. The number of heads in the liquid ejection apparatus is any arbitrary number not smaller than one. When more than one head is included in the liquid ejection apparatus, a tank may be provided for each head. The head may eject any type of liquid different from black ink and preprocessing liquid. The head is not necessarily a line-type head but may be a serial-type head. The recording medium is not limited to a sheet P but may be any type of recordable medium. The capping mechanism is not necessarily composed of a plurality of members (such as the annular member 41 and the opposing member 42 in First Embodiment and the annular member 41 and the conveyance belt 208 of Second Embodiment). For example, the capping mechanism may be constituted by a single concave member which has, on its upper surface, a concave portion which is substantially identical in size with the ejection surface. The tank may be provided with a heater for heating the moisturizing liquid. The water level sensor 58 may not be provided. In such a case, an opening for discharging liquid may be disposed slightly vertically above the maximum water level to discharge the moisturizing liquid through the opening when the water level of the moisturizing liquid exceeds the maximum water level. The moisturization mechanism may be any mechanism different from the tank storing moisturizing liquid, on condition that the air passing through the inflow path is moisturized. For example, a mist generator is used as the moisturization mechanism and mist is supplied to the inflow path. The air passing through the inflow path may be moisturized by ultrasonic moisturization or heat moisturization. The outflow path is not limited to the relatively long path formed in the tube as in the embodiment above. The outflow path may be a relatively short path constituted by a through hole made through the joint 48 of the embodiment above or the like, for example. The atmosphere connection path may not be provided. The valves for opening and closing the inflow path, the outflow path, the atmosphere connection path or the like may not be provided. The ventilator may be disposed on the inflow path or the outflow path, or on both of these paths. In the liquid discharge operation, at least one of the flushing and the purging is conducted, or both of the flushing and the purging are conducted. The purging is not limited to the pressure purging as in the embodiment above, and may be suction purging. In such a case, for example, the pressure in the ejection space is changed to negative pressure by driving a suction pump connected to the capping mechanism, so that the liquid in the ejection opening is sucked. While in the embodiment above the lock sensor is used as the first sensor for detecting the first change, the disclosure is not limited to this arrangement. For example, a sensor for detecting changes in the state of the capping mechanism is attached to a capping mechanism (e.g., the annular member 41), and such a sensor is used as the first sensor. The liquid discharge operation may be conducted not before S15 but after S15 or both before and after S15. The amount of liquid discharged in the liquid discharge operation may be determined sorely based on the first uncapped time, or by any other methods. The liquid discharge operation may be conducted neither before nor after S15. The driving time of the moisturizing pump in S15 may be determined sorely based on the first uncapped time, or by any other methods. For example, in S15 the moisturizing pump is driven for the remaining moisturization time (which is calculated by subtracting, from a predetermined moisturization time, a time length in which the moisturizing pump is driven before the state of the capping mechanism 40 becomes the uncapped state (i.e., the time from the time point of S3 to the time point at which the determination in S4 is made to be YES)). Furthermore, the moisturization time in S15 may not be calculated by adding a time based on the first uncapped time or the like to the remaining moisturization time. The liquid discharge operation may be conducted at least before or after S15 with the moisturization time being sorely the remaining moisturization time in S15. The amount of liquid discharged in S16 may be determined sorely based on the first uncapped time, or by any other methods. Instead of the sensor which detects both the temperature and humidity in the ejection space a sensor which detects one of the temperature and humidity in the ejection space may be provided as the second sensor. The second sensor may not be provided. When switching to the power saving mode, the embodiment is arranged so that the standby current is eliminated by turning off the power of the control substrate of the ventilator. The disclosure, however, is not limited to this arrangement. For example, a stepping motor is used and a holding current is eliminated by cutting off the voltage supplied to the ventilator. During the period which is between the time point at which the state of the capping mechanism is changed from the capped state to the uncapped state and the time point at which the state is returned to the capped state while the air moisturized by the moisturization mechanism is being moved to the ejection space by the ventilator, the driving of the ventilator may not be stopped.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a head comprising an ejection surface in which a plurality of ejection openings for ejecting liquid are formed;

a capping mechanism configured to selectively take a capped state in which an ejection space opposing the ejection surface is covered or an uncapped state in which the ejection space is not covered;

a discharger configured to discharge liquid in the head through the ejection openings;

an inflow path configured to be connected to the ejection space when the capping mechanism is in the capped state and to allow air flow towards the ejection space passing through the inflow path;

an outflow path configured to be connected to the ejection space when the capping mechanism is in the capped state and to allow air flow from the ejection space passing through the outflow path;

a moisturization mechanism configured to moisturize the air passing through the inflow path;

a ventilator configured to move the air in the inflow path to the ejection space;

a first sensor configured to output a first signal, the first signal selectively having a first value corresponding to the capped state of the capping mechanism or a second value corresponding to the uncapped state of the capping mechanism; and a controller configured to:

control the ventilator;

control the discharger;

receive the first signal from the first sensor;

determine whether a first change of the capping mechanism from the capped state to the uncapped state occurred while air moisturized by the moisturization mechanism is being moved to the ejection space by the ventilator or not based on whether the first signal received from the first sensor changes from the first value to the second value;

determine whether a second change of the capping mechanism from the uncapped state to the capped state occurred or not based on whether the first signal received from the first sensor changes from the second value to the first value;

calculate a first uncapped time which is a time length from a time point at which the controller determined the first change occurred to a time point at which the controller determined the second change occurred; and determine whether the first uncapped time is shorter than a first predetermined time when the controller calculates the first uncapped time, wherein the controller controls the ventilator to move the air moisturized by the moisturization mechanism to the ejection space when the first uncapped time is shorter than the first predetermined time, and wherein the controller controls the discharger to discharge the liquid through the ejection openings when the first uncapped time is not shorter than the first predetermined time.

2. The liquid ejection apparatus according to claim 1, wherein:

the controller is further configured to determine an amount of liquid discharged by the discharger based on the first uncapped time; and the controller is configured to control the discharger to discharge the liquid, the amount of which is determined based on the first uncapped time, through the ejection openings at least one of before and after the ventilator is controlled to move the air moisturized by the moisturization mechanism to the ejection space, when the first uncapped time is shorter than the first predetermined time.

3. The liquid ejection apparatus according to claim 2, further comprising a second sensor configured to output a second signal relative to at least one of temperature and humidity in the ejection space, wherein:

the controller is further configured to receive the second signal from the second sensor, and to determine the amount of liquid based on the first uncapped time and the second signal;

the controller is configured to control the discharger to discharge the liquid, the amount of which is determined based on the first uncapped time and the second signal, through the ejection openings at least one of before and after the ventilator is controlled to move the air moisturized by the moisturization mechanism to the ejection space, when the first uncapped time is shorter than the first predetermined time.

4. The liquid ejection apparatus according to claim 1, wherein:

the controller is further configured to determine a time length for which the ventilator moves the air moisturized by the moisturization mechanism to the ejection space based on the first uncapped time; and the controller is configured to control the ventilator to move the air moisturized by the moisturization mechanism to the ejection space for the time length determined based on the first uncapped time, when the first uncapped time is shorter than the first predetermined time.

5. The liquid ejection apparatus according to claim 4, further comprising a second sensor configured to output a second signal relative to at least one of temperature and humidity in the ejection space, wherein:

the controller is further configured to receive the second signal from the second sensor and to determine a time length based on the first uncapped time and the second signal;

the controller is configured to control the ventilator to move the air moisturized by the moisturization mechanism to the ejection space for the time length determined based on the first uncapped time and the second signal, when the first uncapped time is shorter than the first predetermined time.

6. The liquid ejection apparatus according to claim 1, wherein, the controller is further configured to:

determine whether a third change of the capping mechanism from the capped state to the uncapped state occurred while air moisturized by the moisturization mechanism is not being moved to the ejection space by the ventilator or not based on whether the first signal received from the first sensor changes from the first value to the second value;

calculate a second uncapped time which is a time length from a time point at which the controller determined the third change occurred to a time point, at which the controller determined the second change occurred after the third change occurred; and determine whether the second uncapped time is shorter than a second predetermined time and to determine whether the second uncapped time is shorter than a third predetermined time which is longer than the second uncapped time, when the controller calculates the second uncapped time, wherein the controller controls the ventilator to move the air moisturized by the moisturization mechanism to the ejection space when the second uncapped time is shorter than the second predetermined time, wherein the controller controls the discharger to conduct flushing to discharge the liquid through the ejection openings based on flushing data which is different from recording data, when the second uncapped time is not shorter than the second predetermined time and is shorter than the third predetermined time, and wherein the controller controls the discharger to conduct purging to discharge the liquid through the ejection openings by applying a pressure to the liquid in the head, when the second uncapped time is not shorter than the third predetermined time.

7. The liquid ejection apparatus according to claim 1, wherein, the controller is configured to control the discharger to discharge the liquid through the ejection openings and then to switch a driving mode of the ventilator from a normal mode to a power saving mode in which power consumption is restrained as compared to the normal mode, when the first uncapped time is not shorter than the first predetermined time.

8. The liquid ejection apparatus according to claim 1, further comprising:

an opposing member comprising an opposing surface opposing the ejection surface;

a first housing which supports the opposing member; and a second housing which supports the head, configured to move with respect to the first housing, and configured to selectively take a close position at which the second housing is close to the first housing or a separated position at which the second housing is far from the first housing as compared to the close position; wherein:

the head comprises a protrusion with which the ejection space is configured to be covered when a leading end of the protrusion contacts the opposing surface;

the capping mechanism comprises the protrusion and the opposing member;

the capping mechanism is configured to take the capped state when the second housing is at the close position or the uncapped state when the second housing is at the separated position; and the second housing is configured to move with respect to the first housing no matter whether the ventilator is being driven.

9. The liquid ejection apparatus according to claim 8, wherein:

the opposing surface is a supporting surface configured to support a recording medium on which an image is formed by the liquid ejected through the ejection openings.

10. The liquid ejection apparatus according to claim 1, wherein:

the controller is configured to stop the driving of the ventilator during a time length from a time point at which the controller determined the first change occurred to a time point at which the controller determined the second change occurred.

11. A liquid ejection apparatus comprising:

a head comprising an ejection surface in which a plurality of ejection openings for ejecting liquid are formed;

a capping mechanism comprising at least one capping motor, the capping mechanism being configured to selectively take a capped state in which an ejection space opposing the ejection surface is covered or an uncapped state in which the ejection space is not covered;

a discharger configured to discharge liquid in the head through the ejection openings;

an inflow path configured to be connected to the ejection space when the capping mechanism is in the capped state and to allow air flow towards the ejection space passing through the inflow path;

an outflow path configured to be connected to the ejection space when the capping mechanism is in the capped state and to allow air flow out from the ejection space passing through the outflow path;

a moisturization mechanism configured to moisturize the air passing through the inflow path;

a ventilator configured to move the air in the inflow path to the ejection space;

a first sensor configured to output a first signal, the first signal selectively having a first value corresponding to the capped state of the capping mechanism or a second value corresponding to the uncapped state of the capping mechanism; and a controller configured to:

control the ventilator;

control the discharger;

control the at least one capping motor;

receive the first signal from the first sensor;

determine whether a first change of the capping mechanism from the capped state to the uncapped state occurred while air moisturized by the moisturization mechanism is being moved to the ejection space by the ventilator and while the at least one capping motor is not being controlled by the controller or not based on whether the first signal received from the first sensor changes from the first value to the second value;

determine whether a second change of the capping mechanism from the uncapped state to the capped state occurred or not based on whether the first signal received from the first sensor changes from the second value to the first value;

calculate a first uncapped time which is a time length from a time point at which the controller determined the first change occurred to a time point at which the controller determined the second change occurred; and determine whether the first uncapped time is shorter than a first predetermined time when the controller calculates the first uncapped time, wherein the controller controls the discharger to discharge the liquid through the ejection openings when the first uncapped time is not shorter than the first predetermined time.

* * * * *